US010994915B2

(12) United States Patent
Quinn

(10) Patent No.: US 10,994,915 B2
(45) Date of Patent: May 4, 2021

(54) ADAPTABLE BEVERAGE HOLDER

(71) Applicant: 11th Celt, LLC, Swan Valley, ID (US)

(72) Inventor: Patrick T. Quinn, Swan Valley, ID (US)

(73) Assignee: 11th Celt, LLC, Swan Valley, ID (US)

( * ) Notice: Subject to any disclaimer, the term of this patent is extended or adjusted under 35 U.S.C. 154(b) by 79 days.

(21) Appl. No.: 16/512,743

(22) Filed: Jul. 16, 2019

(65) Prior Publication Data

US 2020/0017279 A1 Jan. 16, 2020

Related U.S. Application Data

(60) Provisional application No. 62/698,603, filed on Jul. 16, 2018.

(51) Int. Cl.
*B65D 81/38* (2006.01)
*A45F 5/00* (2006.01)

(52) U.S. Cl.
CPC ..... *B65D 81/3876* (2013.01); *A45F 5/00* (2013.01); *A45F 2005/006* (2013.01); *A45F 2200/0583* (2013.01)

(58) Field of Classification Search
CPC ..... A45F 5/00; A61J 1/16; A61J 9/06; B65D 81/3876; B65D 81/38; E04H 12/2253
USPC ..... 220/741, 739, 737, 592.24, 592.2, 475; 224/148.6, 148.5, 148.4, 148.1, 148.3
See application file for complete search history.

(56) References Cited

U.S. PATENT DOCUMENTS 1,723,731 A * 8/1929 Hafling ..... A61J 9/08 215/11.6
3,263,806 A * 8/1966 Ring ..... B65D 81/3834 206/427
3,578,199 A * 5/1971 Duncan ..... B65D 81/3886 220/315
4,867,358 A * 9/1989 Bennis ..... A45F 3/16 224/148.4
5,048,734 A * 9/1991 Long ..... B65D 81/3886 224/148.3
5,261,554 A * 11/1993 Forbes ..... A45C 11/20 220/592.16
6,073,796 A * 6/2000 Mogil ..... A45F 3/16 215/12.1
6,431,420 B1 * 8/2002 Cragg ..... A45F 5/00 224/222
2018/0132600 A1 * 5/2018 Moreau ..... A45F 5/00
2019/0168946 A1 * 6/2019 Walsh ..... A47J 36/2483

* cited by examiner

*Primary Examiner* — Robert J Hicks
(74) *Attorney, Agent, or Firm* — Workman Nydegger

(57) ABSTRACT

An adaptable beverage holder includes an adjustable sleeve assembly and a mounting assembly. The sleeve assembly is flexible and accommodates beverage containers of different sizes. The mounting assembly can include a sliding bracket and adapters configured to secure the sleeve onto poles and rectangular boards, either horizontal or vertical, as well as other surfaces. The sleeve assembly comprises at least two layers, including an inner insulating layer.

20 Claims, 19 Drawing Sheets

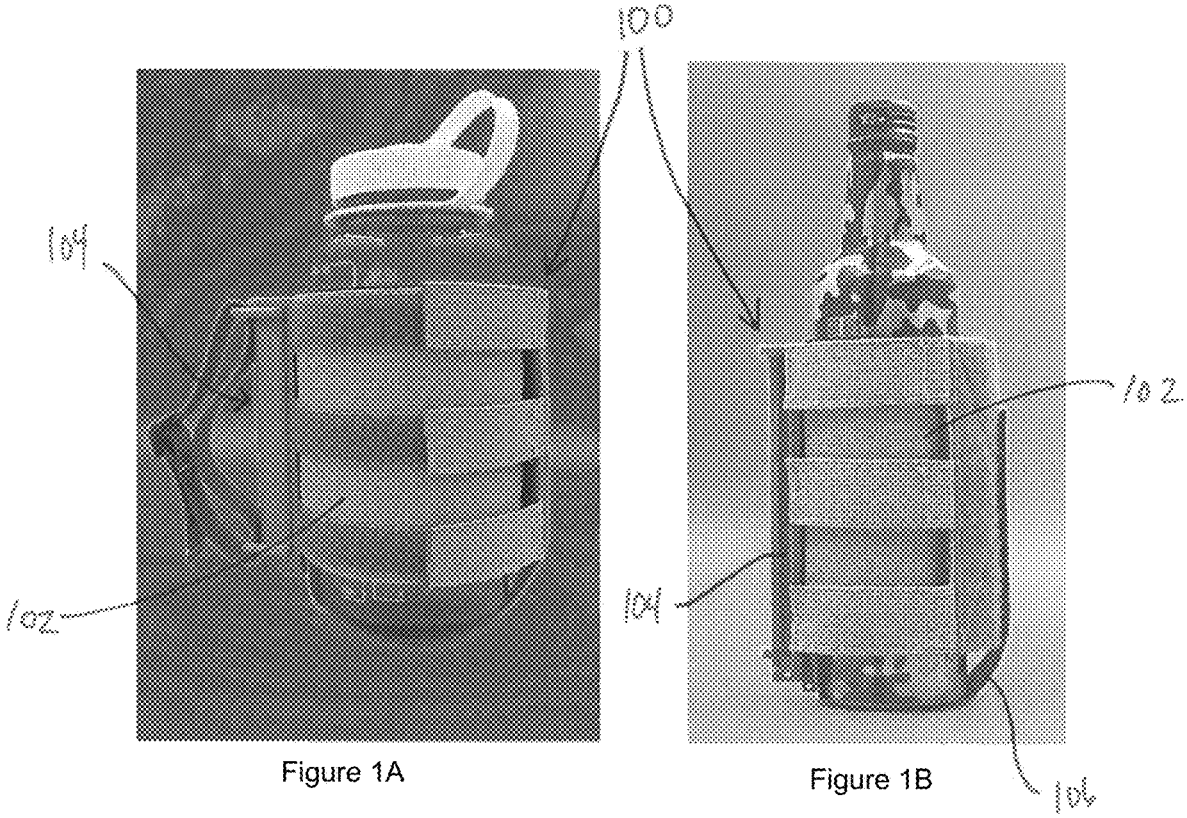
Figure 1A
Figure 1B
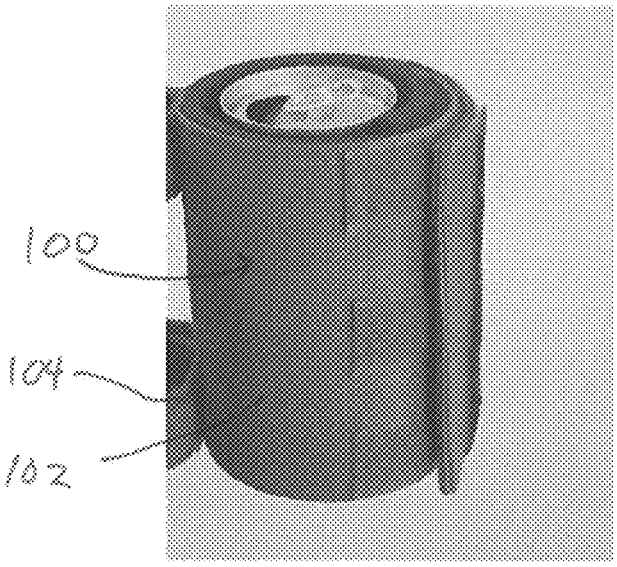
Figure 1C

1506

1510

1512

ADAPTABLE BEVERAGE HOLDER

CROSS-REFERENCE TO RELATED APPLICATIONS

This application claims prior to and the benefit of U.S. Provisional Patent Application Ser. No. 62/698,603, filed on Jul. 16, 2018 entitled ADAPTABLE BEVERAGE HOLDER, which is incorporated herein in its entirety by reference.

BACKGROUND

1. The Field of the Invention

Implementations of the present disclosure relate generally to beverage holders. More specifically, the present disclosure relates to adaptable beverage holder assemblies for outdoor and recreational use.

2. The Relevant Technology

Beverage holders are used to hold beverage containers in various settings, including inside cars, on bicycles, strollers, boats, and the like. Current beverage holders are limited in geometry, size, flexibility, and often fail to sufficiently secure beverage containers during bumpy or otherwise rough conditions. In addition, there are a number of common settings that lack beverage holders entirely and activities during which it is difficult to securely hold a beverage container in place. These activities and settings include outdoor recreation such as hunting, fishing, and hiking, which may involve rafts, canoes, and all-terrain vehicles. During such activities, it is often necessary for one to use both hands to perform an activity so that manually carrying a beverage container is inconvenient, burdensome, dangerous, or impossible.

For example, while fishing on a raft, one typically needs both hands to control a fishing pole and line. When the fishing pole is not being used, paddling the raft or canoe requires both hands as well. Often, rafts and canoes, as well as other recreational equipment and all-terrain vehicles, do not provide built-in beverage holders. If they do, the beverage holders are usually limited in size, flexibility, position, and effectiveness.

Portable beverage holders are available, which attempt to remedy some of the issues described above. However, such portable beverage holders still lack flexibility, adaptability, and effectiveness. For example, a portable beverage holder that is designed for the frame of a bicycle may not be configured to be placed on the frame of a raft. Likewise, a portable beverage holder designed for holding a beverage container onto the frame of an all-terrain vehicle, may not be configured to mount on the outside of a car. Thus, unique beverage holders may be required for each setting so that multiple beverage holders must be purchased. Also, many beverage holders, portable or otherwise, often lack the ability to keep a liquid within the beverage container cool during hot conditions, such as during the various outdoor activities mentioned herein.

Accordingly, there are a number of disadvantages in the art of beverage holders that can be addressed.

BRIEF SUMMARY

The present disclosure relates to beverage holders. More specifically, the present disclosure relates to adaptable beverage holder assemblies for outdoor and recreational use. For example, in one embodiment an adaptable beverage holder comprises an adjustable sleeve assembly having an inner layer comprising an insulating material and an outer layer and a mounting assembly removably secured to the sleeve assembly. In such an embodiment, the mounting assembly is configured to secure the adaptable beverage holder to an object. Such as a pole or board.

In one embodiment, according to the present disclosure, the adaptable beverage holder comprises an adjustable sleeve assembly. The adjustable sleeve assembly comprises an outer layer, an inner layer that comprises an insulating material, and an intermediate layer disposed between the inner and outer layers. The intermediate layer is more rigid than the inner and outer layers. This embodiment of an adaptable beverage holder also comprises a mounting assembly having a sliding mechanism with male and female portions. The male portion is rigidly secured to the intermediate layer of the adjustable sleeve assembly and the female portion comprises an extension configured to secure the female portion to a pole or board. A locking mechanism is also included, which comprises a key and a keyhole. The locking mechanism is configured to prevent the male and female portions of the sliding bracket from separating.

Another embodiment of an adaptable beverage holder, according to the present disclosure, also comprise a tether attached by a first end to a mounting assembly. In some examples, the tether may be configured as a selectively closed loop, wherein a second end of the tether is fastened to the mounting assembly by a ring assembly system. In other examples, the tether may be configured as a partially closed loop, wherein a second end of the tether is fastened to the mounting assembly by a ring assembly system. In other examples, an adaptable beverage may include a tether that is configured to be interchangeable between a selectively closed loop and a partially closed loop.

Another embodiment, according to the present disclosure, includes an adaptable beverage holder kit. The kit comprises an adjustable sleeve, a mounting assembly including a sliding bracket, and a key.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or embodiments thereof which are illustrated in the appended drawings. Understanding that these drawings depict only typical implementations and/or embodiments of the invention and are not therefore to be considered to be limiting of its scope, the invention will be described and explained with additional specificity and detail through the use of the accompanying drawings in which:

FIGS. 1A-C show pictures of various embodiments of an adaptable beverage holder sleeve according to the present disclosure;

DETAILED DESCRIPTION

Figure 2A:
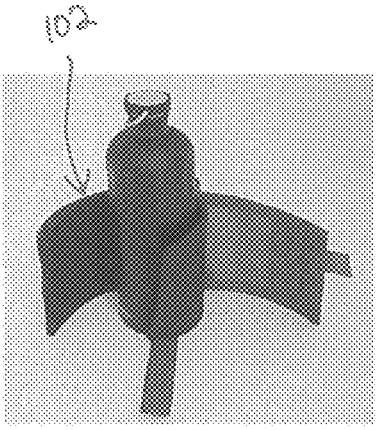
FIGS. 2A-E show pictures illustrating a process for securing a beverage container within an embodiment of an adaptable beverage holder sleeve according to the present disclosure.

The present disclosure relates generally to beverage holders. More specifically, the present disclosure relates to adaptable beverage holder assemblies for outdoor and recreational use. The various embodiments of beverage holders described in the present disclosure solve many of the problems in the art described above. For example, beverage holders described herein provide means to securely support and retain beverage containers to a variety of poles, boards, curved or flat surfaces, whether horizontal or vertical, while securely retaining the beverage containers during bumpy or rough conditions. Alternatively, or additionally, adaptable beverage holders may provide means to securely fastened and retain beverage containers to the body of a user. Adaptable beverage containers of the present disclosure can also be adjusted to retain various sizes of beverage containers and keep fluid within the containers cool in hot conditions, and hot in cool conditions. Thus, the adaptable beverage holders of the present disclosure can effectively retain a variety of beverage containers and be easily moved from one setting to another without the need to buy separate beverage holders for separate activities and equipment. Adaptable beverage containers of the present disclosure may include a mounting assembly that has an adjustable strap. The adjustable strap may be configured to form at least a partial loop that traverses the length of an adaptable beverage container. Alternatively, or additionally, the adjustable strap may be configured to form a loop at one end of the adaptable beverage container.

For example, FIGS. 1A-C show pictures of various embodiments of an adaptable beverage holder 100, including a sleeve assembly 102 and a mounting assembly 104, according to the present disclosure. The sleeve assembly 102 of the various adaptable beverage holders comprise multiple layers, including an outer layer, intermediate layer, and inner layer. One or more other embodiments of sleeve 102 may include more or less than the three layers illustrated in FIGS. 1A-C. Generally, the outer layer comprises a flexible, weather resistant, tough material. Preferably, the material is resistant to tearing and withstands harsh outdoor conditions, both wet and dry, hot and cold.

As a non-limiting example, the outer layer of sleeve 102 may comprise PVC polyester coated outdoor marine fabric. Other similar fabrics may also be used in combination with, or in place of, such PVC material in one or more other embodiments. The thickness of the outer layer may vary between embodiments while maintaining the same functionality. In addition, in one or more other embodiments, the outer layer may comprise one or more synthetic or natural materials, such as flexible plastics and polymers, rubber, cotton, wool, or the like.

The intermediate layer of the sleeve 102 may comprise a somewhat more rigid material than the outer and inner layers, such that the intermediate layer provides a material to which mounting assembly 104 components and other hardware may be rigidly secured. For example, in one embodiment, the inner layer may comprise a sheet of 1/32-inch thick High-Density Polyethylene (HDPE). Such a material is flexible enough wrap around beverage containers of various sizes but rigid enough to mount hardware and other components thereto. Other plastics, rubbers, polymers, and the like may also be used in combination with, or in place of, HDPE to form the intermediate layer of sleeve 102.

Also, one or more embodiments of sleeve 102 may comprise an intermediate layer that is thicker or thinner than 1/32-inch described. In addition, the intermediate layer may be non-uniform in thickness. For example, a portion of the intermediate layer may be thicker where hardware and mounting assembly 104 components are to be secured. Likewise, in one or more embodiments of sleeve 102, the intermediate layer may be equal to the size of the outer layer, so that the intermediate layer completely surrounds a beverage container place within sleeve 102, or less than the size of the outer layer so that the intermediate layer does not completely surround the beverage container.

The inner layer of sleeve 102 may insulate the beverage container and provide a surface with enough friction as it interacts with the beverage container to secure the beverage container within sleeve 102. One non-limiting example of a suitable material for the inner layer is neoprene. Neoprene provides friction between the inner layer and the beverage container and also acts as an insulator to keep the beverage container contents hot or cool. Other materials, which may also be suitable for the inner layer, may be used alone or in combination with neoprene to form the inner layer. The inner layer may also be flexible enough to wrap around a beverage container and adjust to the size and shape of the beverage container.

In addition to the various layers of sleeve 102 described above, sleeve 102 may also comprise a number of hook-and-loop portions and straps. As seen in FIGS. 1A-C, the configuration and placement of the various hook-and-loop portions of sleeve 102 may vary between different embodiments. For example, the embodiment of sleeve 102 shown in FIGS. 1A and 1B include three horizontal hook-and-loop straps that correspond to three horizontal portions of the outer layer having complimentary hook-and-loop material disposed thereon. In addition, as shown in FIG. 1B, sleeve 102 may also comprise a vertical section of hook-and-loop material to which a bottom retaining strap can be secured. The bottom retaining strap 106 comprises complimentary hook-and-loop material that secures to the vertical hook-and-loop portion of sleeve 102 and runs across a bottom opening of sleeve 102 to prevent the beverage container from falling down and out of the beverage holder 100.

As another example, FIG. 1C shows an embodiment of sleeve 102 that does not include separate hook-and-loop straps. Rather, in the embodiment shown, an inside portion of the outer layer is equipped with complimentary hook-and-loop material that secures to three horizontal hook-and-loop portions of the outer layer. In this configuration, the outer layer can be wrapped around the beverage container so that it overlaps itself and secures together via opposing hook-and-loop portions. One of ordinary skill in the art will appreciate that, in addition to the various embodiments described herein, any number of combinations of straps, hook-and-loop portions, and combinations thereof, may be utilized to form sleeve 102 so that sleeve 102 can be wrapped around a beverage container and be held together while supporting the container.

Figure 2B:
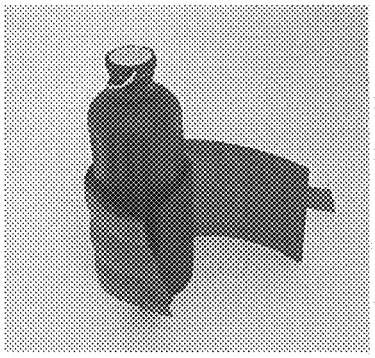

Along these lines, FIGS. 2A-E show pictures illustrating a process for securing a beverage container within an embodiment of an adaptable beverage holder 200. The embodiment illustrated includes a sleeve 102 having only two layers, including an outer layer and an inner insulating layer. As shown in FIG. 2A, the inner and outer layers of sleeve 102 are at least partially independent of one another so that they can be at least partially separated and wrapped around a beverage container individually. The inner layer may be wrapped around the beverage container first, as shown in FIG. 2A. Next, as shown in FIG. 2B, the outer layer can be wrapped around the inner layer and beverage container.

Figure 2C:
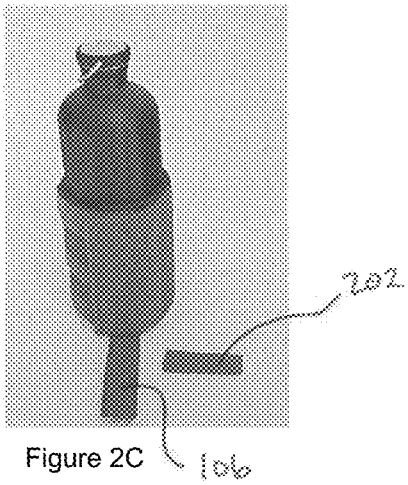
Figure 2D:
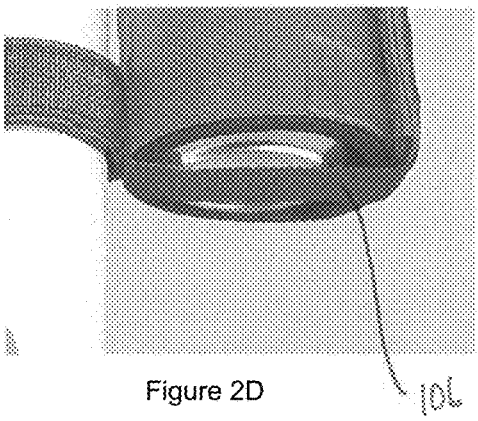
Figure 2E:
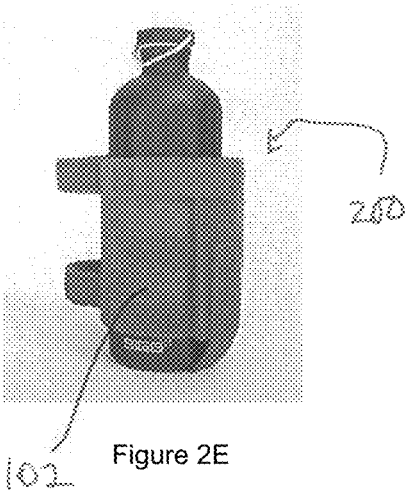
Figures 3A, 3B, 3C, 3D, 3E, 3F:
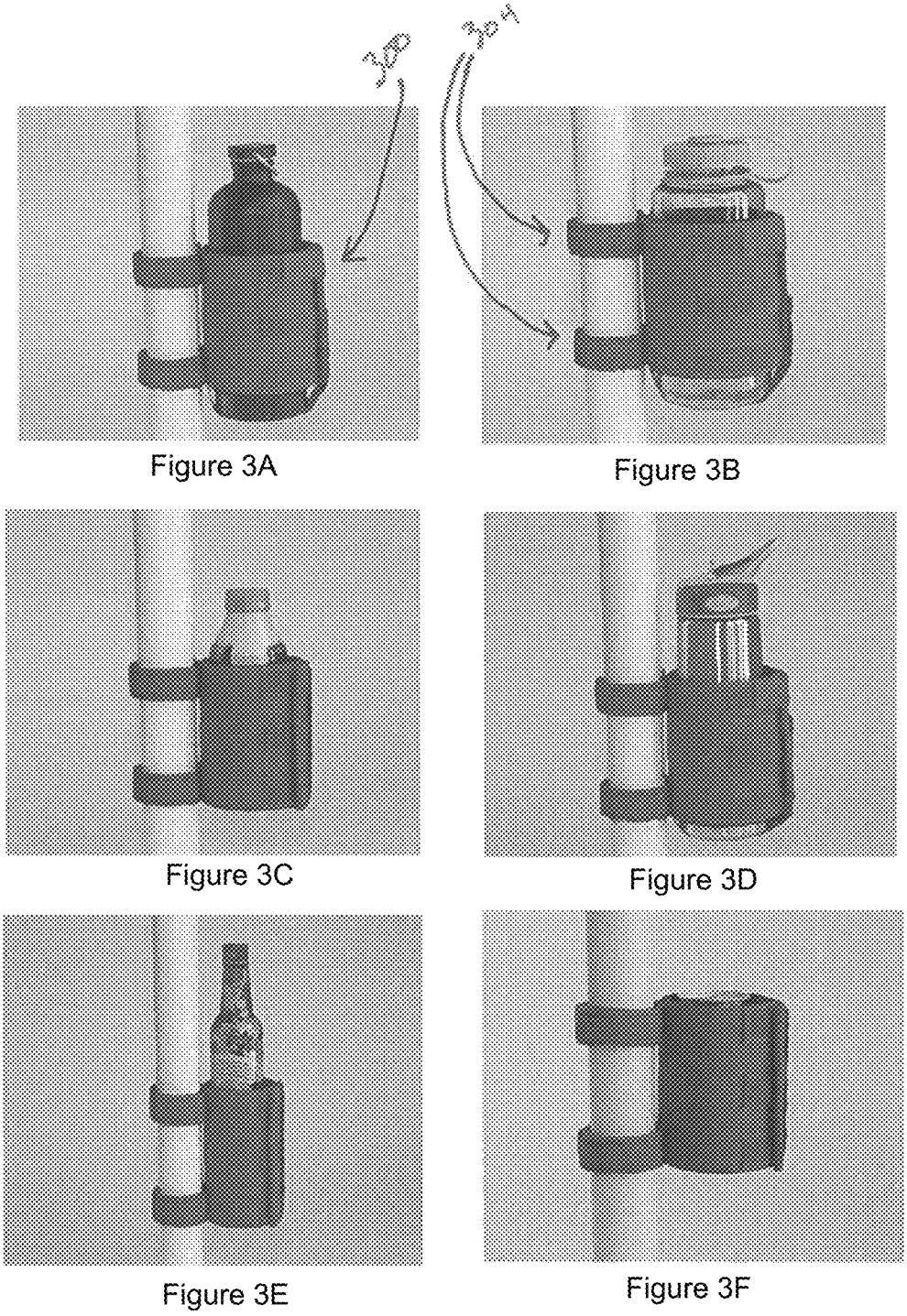
FIGS. 3A-F show pictures of an adaptable beverage holder sleeve accommodating beverage containers of various sizes according an embodiment of the present disclosure.

FIG. 2C shows the outer layer of sleeve 102 secured to itself via various hook-and-loop portions so that sleeve 102 remains wrapped around the container. FIG. 2C also shows the bottom retaining strap 106 extending below the beverage container, but not yet secured entirely to the beverage holder 200. The bottom retaining strap 106 can be pulled taught underneath sleeve 102 and turned upward to secure to the outer layer of sleeve 102, as shown in FIG. 2D. In this way, the bottom retaining strap 106 prevents the beverage container from falling down and out of sleeve 102. FIG. 2E shows a fully assembled beverage holder 200, including a fully assembled sleeve 102 having a beverage container secured therein.

The same process of securing a beverage container with the beverage holder 200 shown in FIGS. 2A-E may also apply to other embodiments of beverage holders described herein. For example, beverage holders that include an intermediate layer may also be used to wrap around a beverage container in the same way as described above. That is, the intermediate layer also wraps at least partially around the beverage container between the outer and inner layers of sleeve 102. Also, one or more embodiments of the beverage container 200 may include a sleeve 102 having layers that are integrally connected so that each layer is not wrapped around the beverage container separately. That is, the multiple layers of sleeve 102 may be sewn, glued, or otherwise secured together so that they cannot be separated. In such a configuration, all the layers may be wrapped around the beverage container together in one step, rather than separately. Also, as shown in FIG. 1C, one or more of the securing straps may be removable entirely from sleeve 102 so that it can be placed anywhere on the outer layer to aid in securing sleeve 102 around the beverage container.

One will appreciate that the flexible sleeve 102 equipped with hook-and-loop fastener materials is capable of conforming to a variety of different shapes and sizes of beverage containers. To illustrate this point, FIGS. 3A-F show pictures of a beverage holder sleeve accommodating beverage containers of various sizes. In these Figures, the beverage holder 300 includes a mounting assembly 304 that secures the sleeve to a vertical pole. The illustrated embodiment of mounting assembly 304 includes two mounting straps that are secured to the sleeve and wrap around the pole. The mounting assembly 304 of FIGS. 3A-F includes two mounting straps, however one or more other embodiments may comprise one mounting strap, three mounting straps, or more than three mounting straps.

Figure 4:
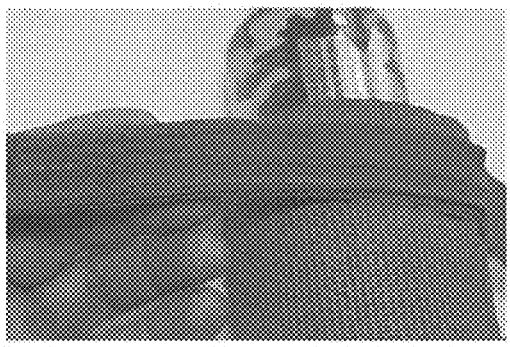
FIG. 4 shows a picture of the inside surface of an attachment strap according to an embodiment of the present disclosure.

FIG. 4 illustrates a mounting strap in an open configuration showing an interior surface of the mounting strap. The interior surface of the mounting strap may comprise a high friction material, such as various rubbers or other polymers, which grips a pole or other surface around which the strap is wrapped. Some portions of the strap may also include complimentary hook-and-loop material that secures the strap together when it wraps around a pole and overlaps onto itself. In one or more other embodiments, the strap may comprise other materials on the interior surface, exterior surface, and means other than hook-and-loop material that allows the strap to be adjustably secured around a pole or other object of various dimensions. Once the straps are secured around the pole, the friction between the pole and the interior surface of the strap prevents the beverage holder from sliding down the pole.

One will appreciate that the straps of the mounting assembly 304 illustrated in FIGS. 3A-F can also be oriented 90-degrees from the straps illustrated so that the beverage holder 300 can be mounted to horizontal pole or board while maintaining the beverage container in a vertical orientation.

Figure 5:
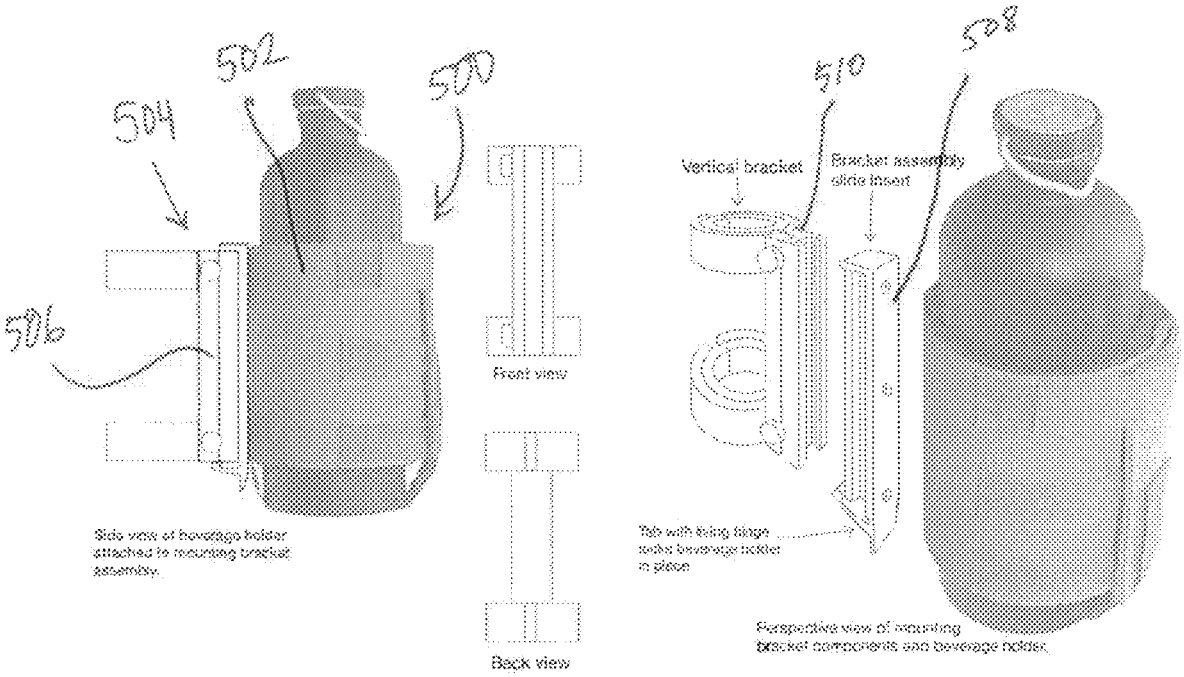
FIG. 5 illustrates various views of an adaptable beverage holder sleeve and mounting assembly, including a sliding bracket, according to an embodiment of the present disclosure.

One or more other embodiments may include other mounting assemblies that are configured to secure a sleeve of the various beverage holders described herein to vertical or horizontal objects, such as poles, boards, and the like. For example, FIG. 5 illustrates various views of a beverage holder sleeve 500, including sleeve 502 and mounting assembly 504. The mounting assembly includes a sliding bracket 506 that includes separable male and female portions 508, 510. The male portion 508 comprises a ridge that first within a groove of the female portion 510. In addition, the male portion 508 may be rigidly secured to sleeve 502 so that connecting the male portion 508 to the female portion 510 secures sleeve 502 to the female portion 510 of the mounting assembly 504.

Additionally, in one embodiment, as described above, the sleeve 502 may comprise an intermediate layer to which the male portion 508 of the mounting assembly 504 is rigidly secured. As further illustrated in FIG. 5, the female portion 510 of the mounting assembly 504 may include one or more clamps configured to secure the mounting assembly 504, and thus the beverage holder 500, to a vertical pole. One embodiment may include one bracket or more than two brackets. The brackets function similar to the mounting straps described above. That is, the brackets produce friction between a pole and the interior surface of the brackets that prevents the beverage holder from sliding vertically down a pole. The male portion 508 of the mounting assembly 504 can selectively slide in and out of the female portion 510 so that the sleeve 500 can be easily removed as needed.

Figure 6A:
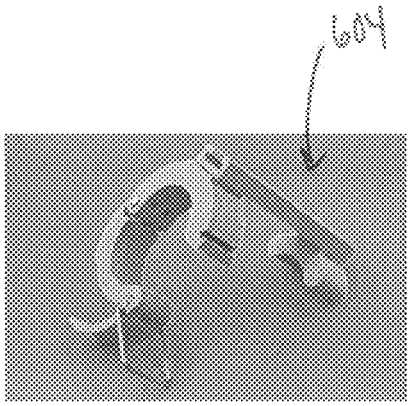
FIGS. 6A-C show pictures of a mounting assembly configured to secure the sleeve to a vertical pole according to an embodiment of the present disclosure.
Figure 6B:
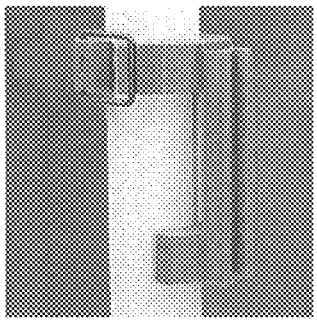
Figure 6C:
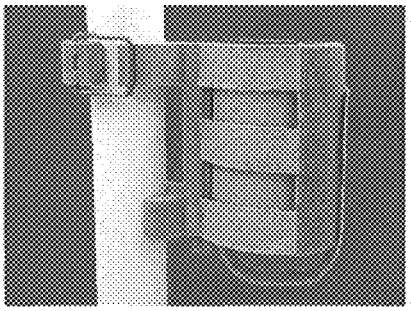

FIGS. 6A-C show various views of another embodiment of a mounting assembly 604. In this embodiment, the female portion comprises an upper clamp, similar to the clamps shown in FIG. 5, and a lower arcuate portion that extends from the female portion to partially curve around a pole. As shown in FIG. 6B, the arcuate portion rests against the pole when the upper clamp is secured thereto. Again, as shown in FIG. 6C, the sleeve of the beverage holder, which includes the male portion of the mounting assembly secured thereto, can be removably secured to the female portion, and thus the pole.

Figure 7A:
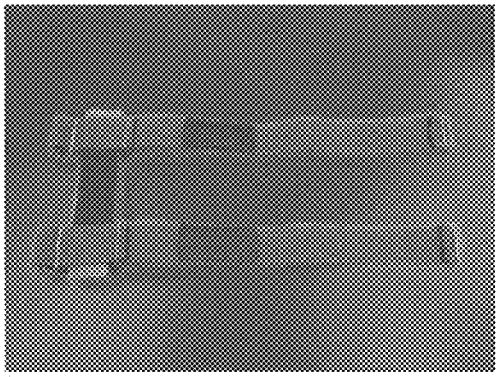
FIGS. 7A-D show pictures of a mounting assembly configured to secure the sleeve to a vertical pole according to an embodiment of the present disclosure.
Figure 7B:
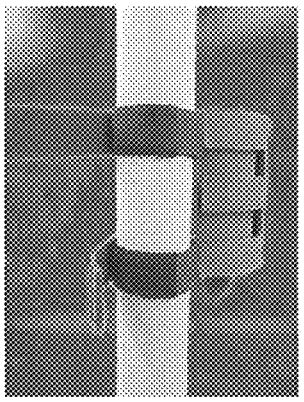
Figure 7C:
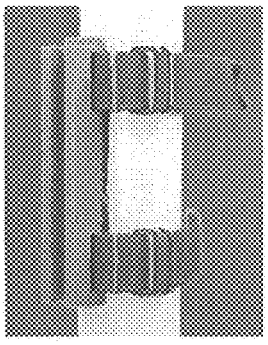
Figure 7D:
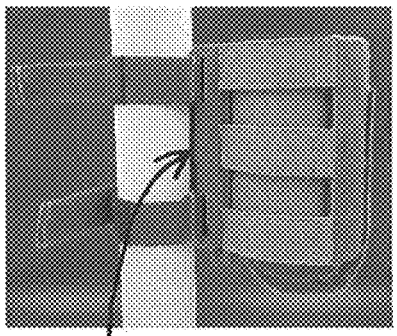

Another example of an embodiment of a mounting assembly 704 is illustrated in FIGS. 7A-D. This embodiment illustrates a combination of elements from other mounting assemblies described herein. The mounting assembly of FIGS. 7A-D includes two straps looped through openings in the female portion of the sliding bracket. The straps can be looped around the vertical pole to secure the female portion of the sliding bracket to the pole. The male portion of the sliding bracket, which is secured to the sleeve, can then be removably secured to the female portion of the sliding bracket to secure a beverage container to the pole. In one or more other embodiments, the mounting assembly shown in FIGS. 7A-D may include more or less than two straps. Also, the straps may include various hardware or hook-and-loop portions of material to allow the straps to be wrapped around a pole and secured thereto, either due to hook-and-loop materials overlapping or due to various strap adjustment mechanisms, as shown in FIG. 7C specifically.

FIG. 7A shows two straps in an open configuration, exposing the interior surfaces thereof. As shown, the interior surfaces of the straps may include one or more portions of rubber, or other high friction material, disposed along the straps at positions that correspond to contact points between the straps and the pole. These high friction portions of the straps aid in securing the beverage container to a pole without the pole sliding vertically down the pole due to the weight of a beverage container or other forces. One will appreciate that these high friction portions of materials on the straps shown in FIGS. 7A-D can also be applied to any of the straps described in other embodiments herein.

Figure 8:
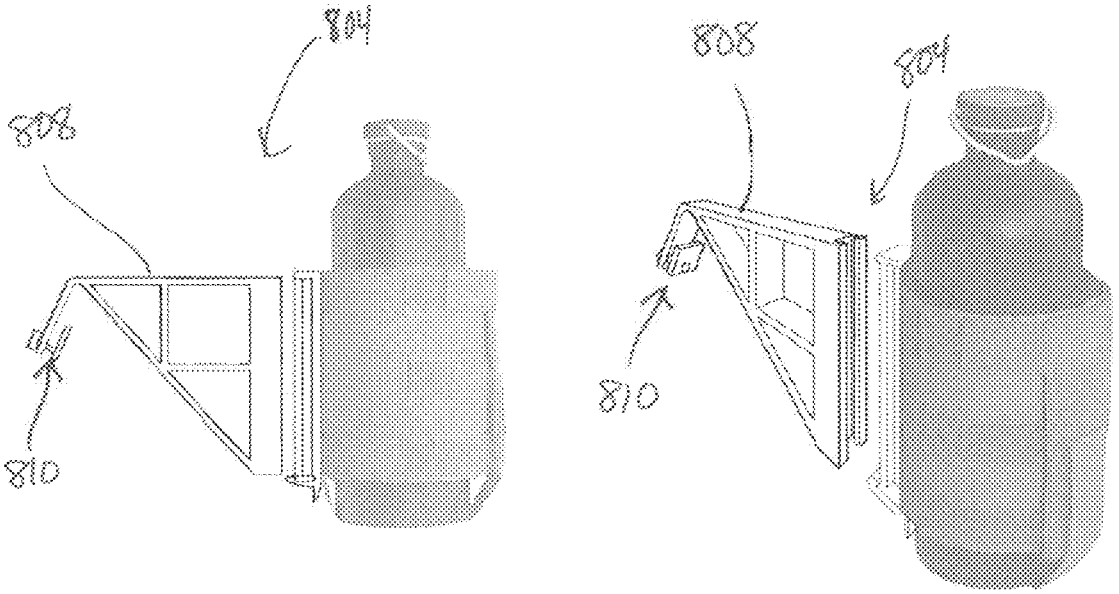
FIG. 8 illustrates various views of an adaptable beverage holder sleeve and mounting assembly, including a triangle bracket, according to an embodiment of the present disclosure.

FIG. 8 illustrates various views of an embodiment of a mounting assembly 804 that includes a triangle frame component 808 extending from the female portion of the sliding bracket. The triangle frame component 808 includes a protruding portion having a securing mechanism 810 attached thereto. The securing mechanism 810 can be used to mount the mounting assembly onto a slanted surface, while maintaining the beverage container in an upright position, as shown.

Figure 9:
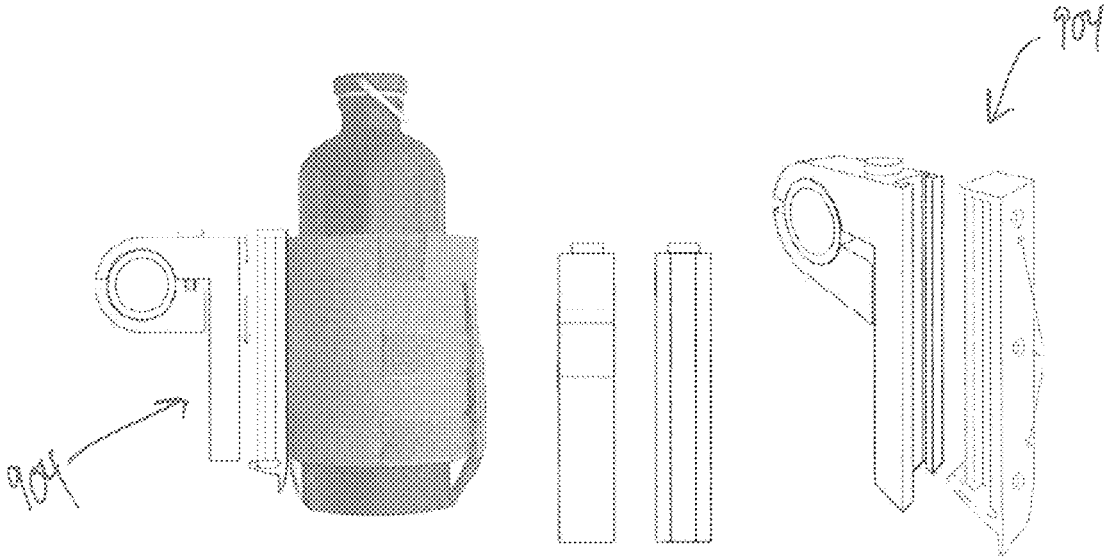
FIG. 9 illustrates various views of an adaptable beverage holder sleeve and mounting assembly configured to secure the beverage holder to a horizontal pole according to an embodiment of the present disclosure.
Figure 10A:
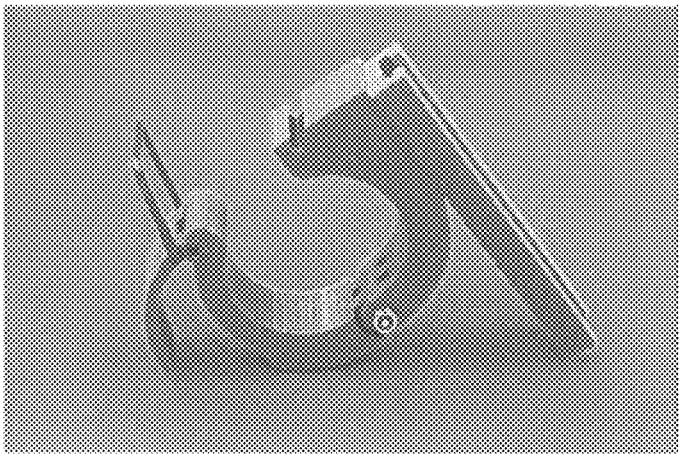
FIGS. 10A-D show pictures of a mounting assembly, including a clamp, configured to secure a sleeve to a horizontal pole according to an embodiment of the present disclosure.
Figure 10B:
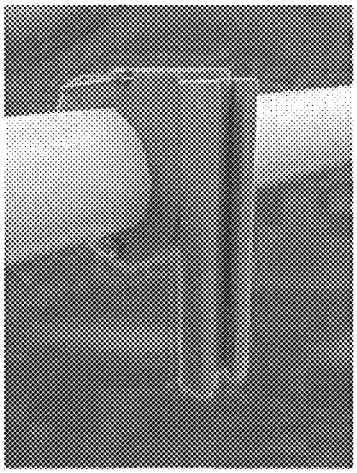
Figure 10C:
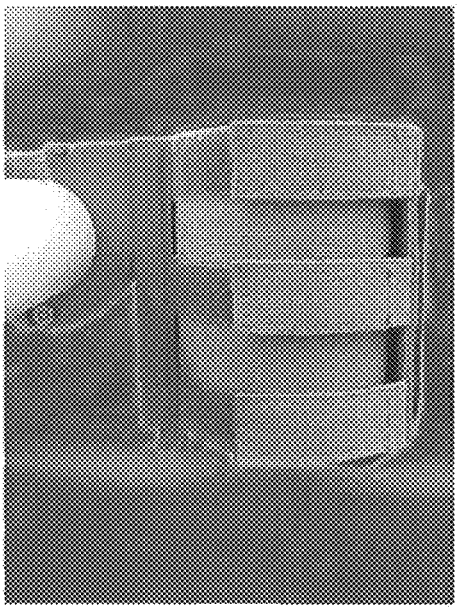
Figure 10D:
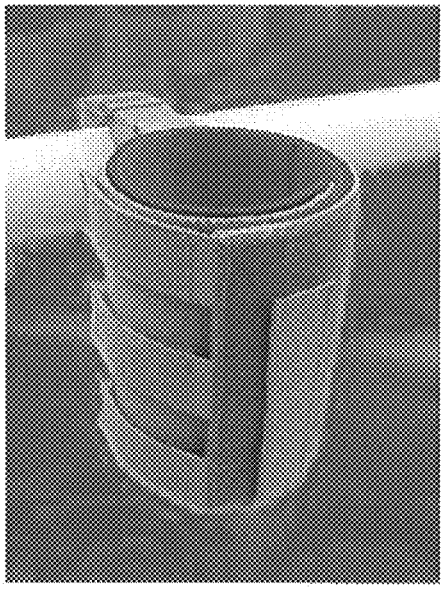

FIG. 9 illustrates various views of a beverage holder configured to secure a beverage container to a horizontal pole. This embodiment of a mounting assembly 904 also includes a sliding bracket having male and female portions. However, in this embodiment, the female portion of the sliding bracket includes a circular clamp extending therefrom, which is configured to be secured to a horizontal pole. FIGS. 10A-D also show pictures of a beverage holder configured to secure a beverage container to a horizontal pole. The clamp extending from the female portion of the sliding bracket in FIGS. 10A-D comprises a quick release mechanism that assists a user in securing the clamp around a pole.

Figure 11:
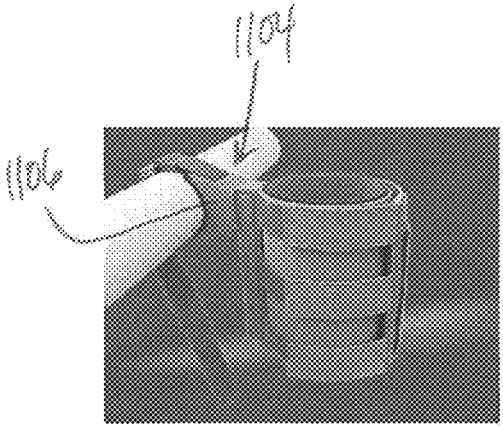
FIG. 11 shows a picture of a mounting assembly, including a concave adapter, configured to secure a sleeve to a horizontal pole according to an embodiment of the present disclosure.
Figure 12A:
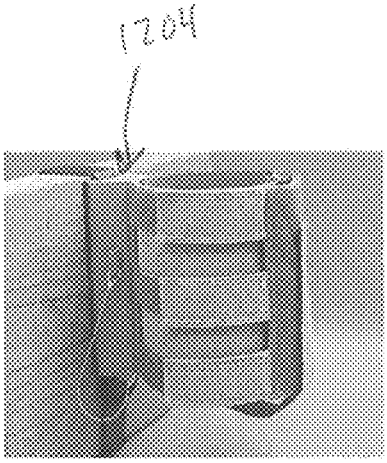
FIGS. 12A-F show pictures of a mounting assembly, including a sliding bracket and straps, configured to secure a sleeve to a flat surface according to an embodiment of the present disclosure.
Figure 12B:
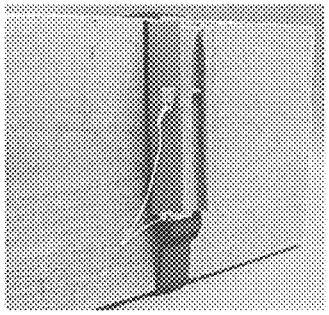
Figure 12C:
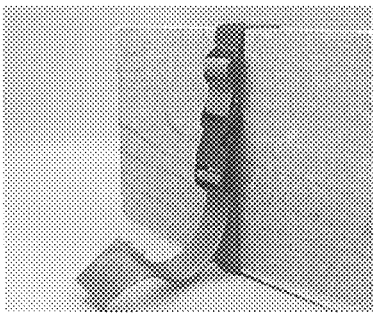
Figure 12D:
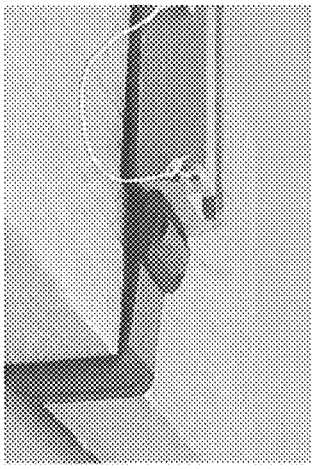
Figure 12E:
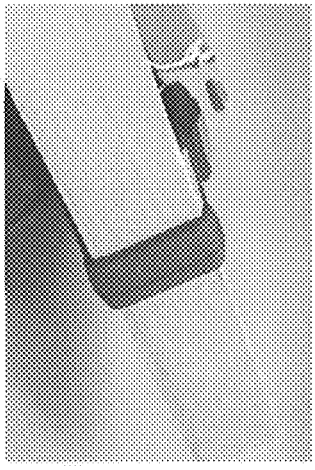
Figure 12F:
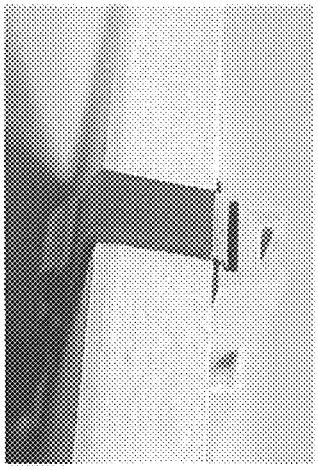

FIG. 11 shows a picture of a mounting assembly, including a concave adapter extending from the female portion of the sliding bracket. The concave adapter includes a curvilinear surface configured to compliment the curvature of the pole to which the beverage holder is being secured. In addition, the concave adapter includes one or more holes or passageways through which one or more straps can be passed and wrapped around the pole. The curvilinear surface of the concave adapter may comprise high friction materials, as noted with reference to other embodiments described herein.

FIGS. 12A-F show pictures of a mounting assembly 1204, including a sliding bracket and straps, configured to secure a sleeve to a flat surface, such as the face of a rectangular board, according to an embodiment of the present disclosure. In this embodiment, the female portion of the sliding bracket includes a passageway through which a strap may pass along the length of the female portion. The strap may be adjustable and wrapped around a rectangular board. As such, the female portion of the sliding bracket may rest up against a surface of the rectangular board and include a high friction material thereon to prevent sliding along the surface of the board. Again, as noted above, the strap shown in FIGS. 12A-F may also include one or more portions of high friction material to prevent sliding.

FIGS. 13A-D show pictures of a mounting assembly 1304 that includes a sliding bracket, planar adapter 1308, and a strap, configured to secure the beverage holder to a flat surface, such as one surface of a rectangular board. This embodiment of the mounting assembly is similar to that shown in FIGS. 12A-F except that the strap does not pass through the female portion of the sliding bracket. Rather, the female portion includes a concave adapter 1106 extending therefrom. The concave adapter 1106 is coupled with the planar adapter 1308 and both adapters 1106, 1308 include holes/passageways through which the strap passes.

Figure 13A:
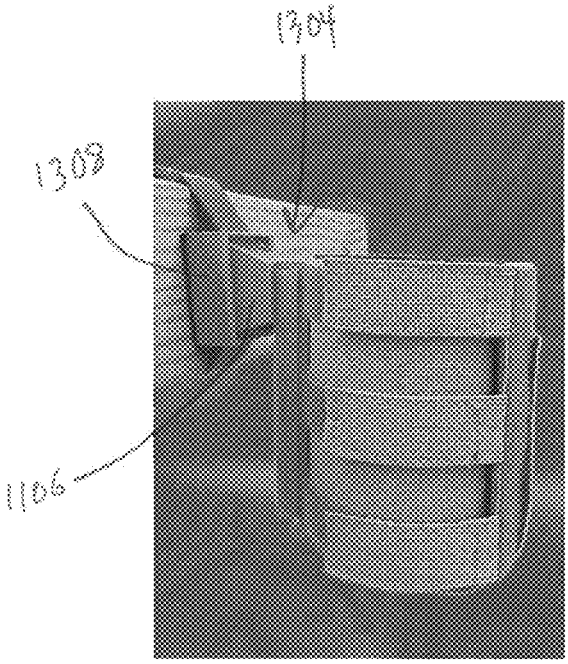
FIGS. 13A-D show pictures of a mounting assembly, including a sliding bracket, planar adapter, and straps according to an embodiment of the present disclosure.
Figure 13B:
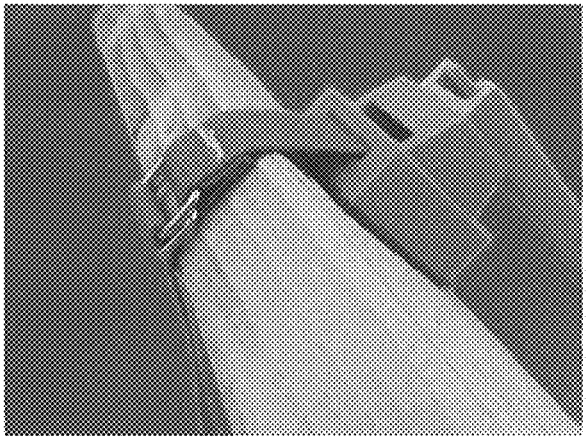
Figure 13C:
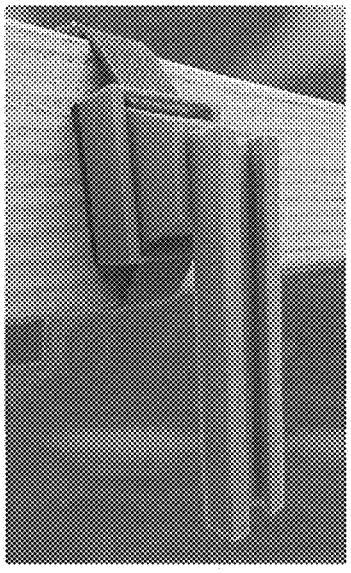
Figure 13D:
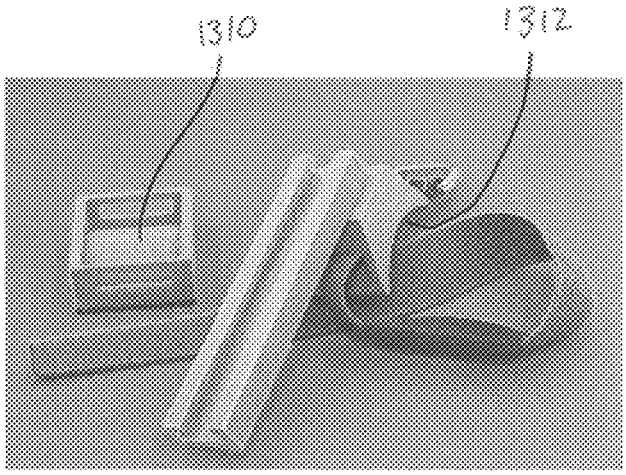
Figure 14A:
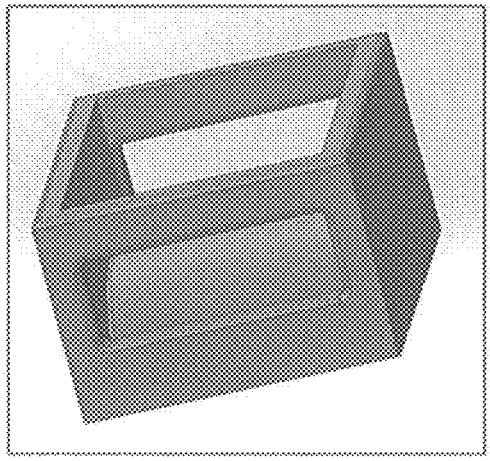
FIGS. 14A-D illustrate various concave and planar adapters for use in a mounting assembly according to an embodiment of the present disclosure.
Figure 14B:
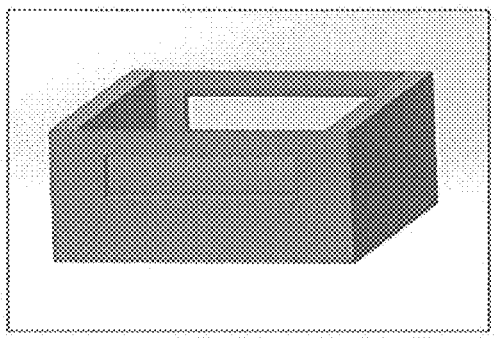
Figure 14C:
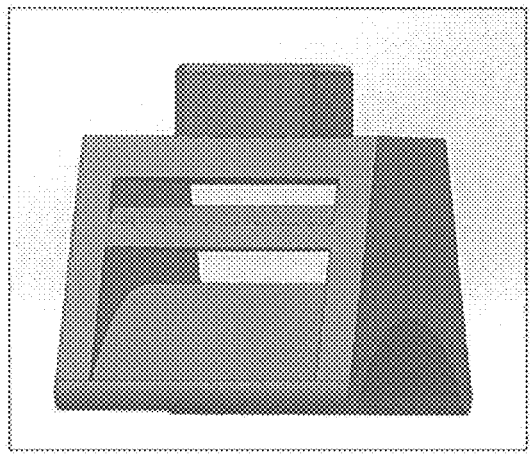
Figure 14D:
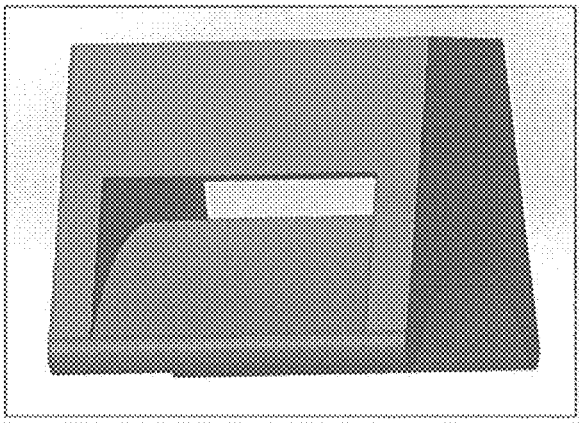

When the strap is secured tightly around the board, the strap holds the two adapters 1106, 1308 together and thus holds the beverage holder to the board. FIG. 13D shows the planar adapter 1308 and concave adapter 1106 separated to expose a convex interior surface 1310 within the planar adapter 1308 that mates with the concave surface 1312 of the concave adapter 1106 when the strap holds the two adapters 1106, 1308, as shown in FIGS. 13A-C. In one or more embodiments, the planar adapter 1308 may also include high friction material disposed on the flat side of the planar adapter 1308 to effectively grip the flat surface of the board.

Along these lines, FIGS. 14A-D illustrate various concave and planar adapters 1106, 1308 for use in a mounting assembly according the embodiment described herein. FIGS. 14A-D illustrate various sizes of adapters that can be used to position a beverage holder at varying distances from a pole or rectangular board, as described above. FIGS. 14A-D also show the holes/passageways through which one or more strap may pass, also as described above.

Another embodiment of a mounting assembly 1504 configured to secure a beverage holder to a horizontal pole is shown in FIGS. 15A-D. The illustrated mounting assembly includes a clamp 1506 and a base-mounted sliding bracket 1508. Mounting assembly 1504 is configured to secure a beverage container to a horizontal pole so that the beverage container lies above the pole. Other configurations and embodiments, such as those shown in FIGS. 9-13D, are configured to secure a beverage container at or below the level of the horizontal pole or board. This may be advantageous in certain situations, for example, on the frame of a paddle boat so the beverage container lies low enough to avoid interfering with moving paddles or oars. Likewise, it may be advantageous to dispose the beverage container above a horizontal pole or board, such as the upper frame of an all-terrain vehicle, to avoid obstructing the view of the driver, or in other situations.

Figure 15A:
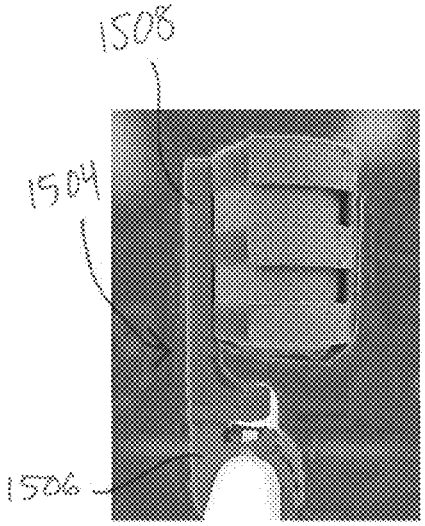
FIGS. 15A-F show pictures of a mounting assembly, including a clamp and a base-mounted sliding bracket, configured to secure a sleeve to a horizontal pole according to an embodiment of the present disclosure.
Figure 15B:
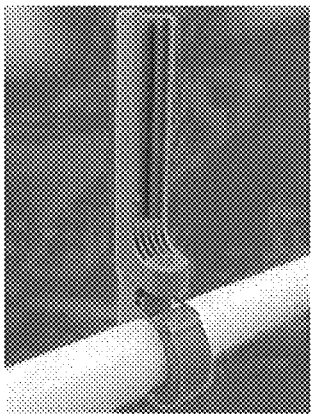
Figure 15C:
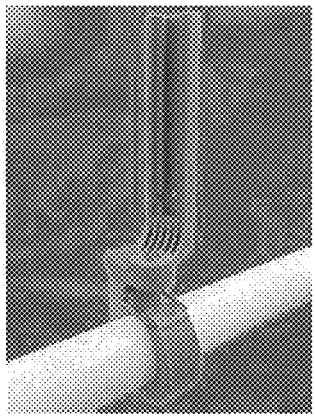
Figure 15D:
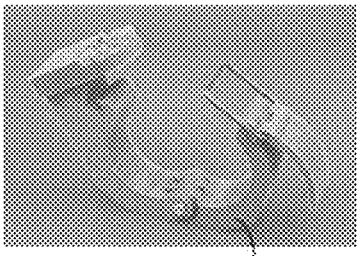
Figure 15E:
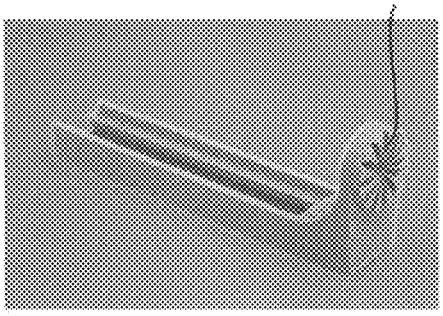
Figure 15F:
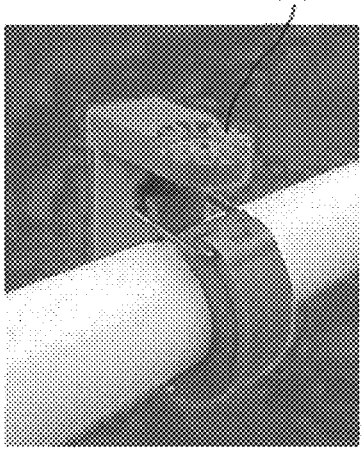
Figure 16A:
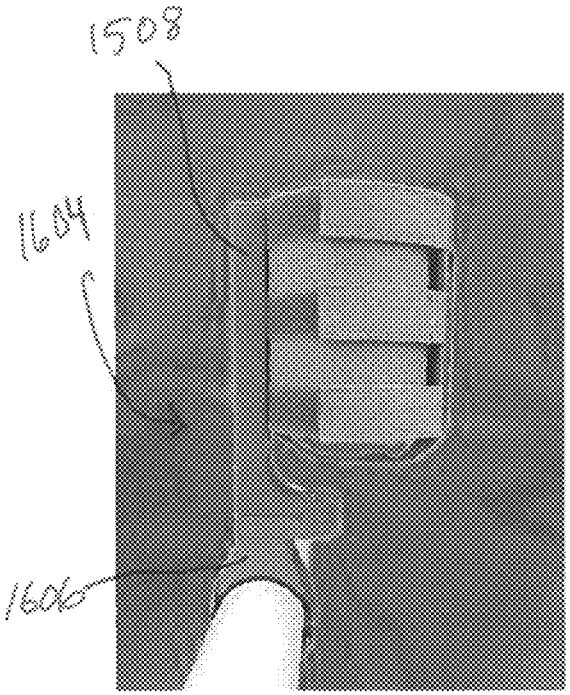
FIGS. 16A-D show pictures of a mounting assembly, including a concave adapter and straps connected to a base-mounted sliding bracket, configured to secure a sleeve to a horizontal pole according to an embodiment of the present disclosure.
Figure 16B:
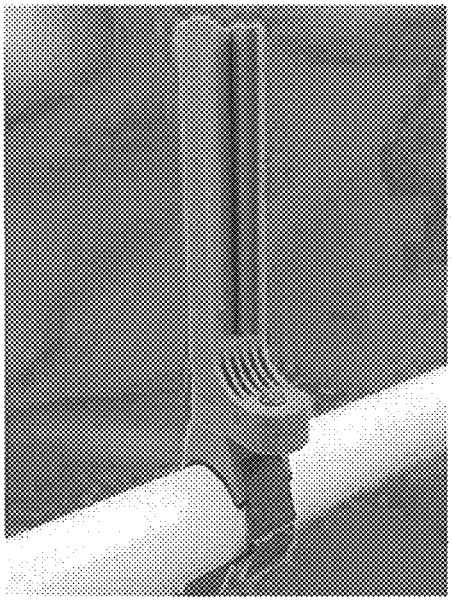
Figure 16C:
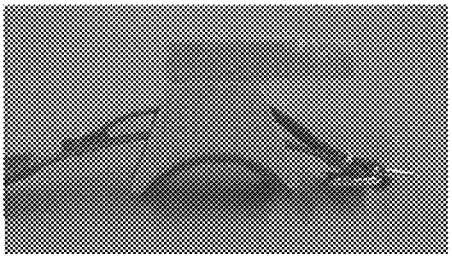
Figure 16D:
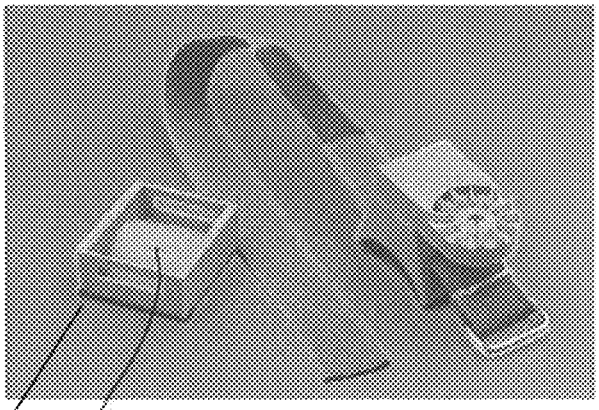
Figure 17A:
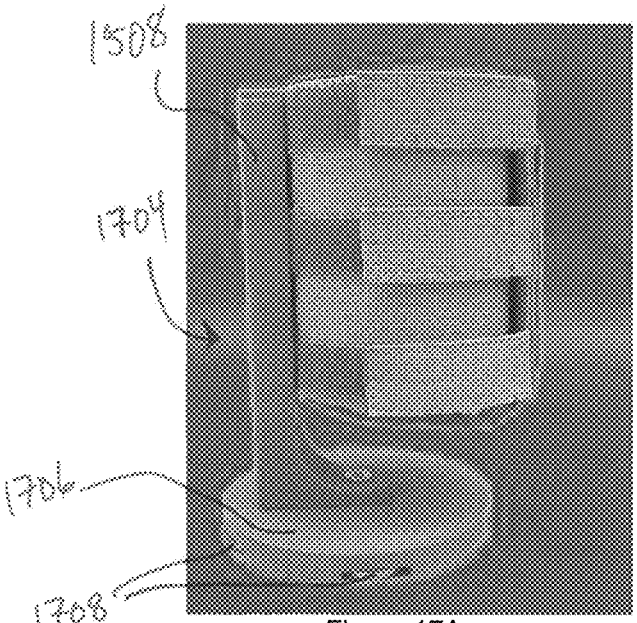
FIGS. 17A-E show pictures of a mounting assembly, including a magnetic plate and a base-mounted sliding bracket, configured to secure a sleeve to a metal surface according to an embodiment of the present disclosure.
Figure 17B:
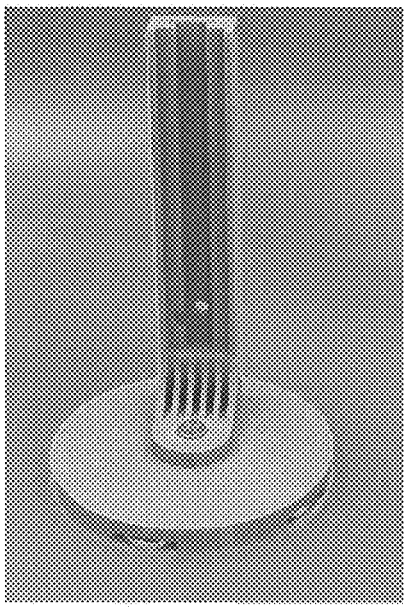
Figure 17C:
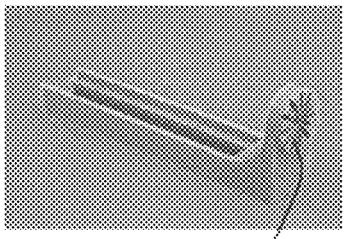
Figure 17D:
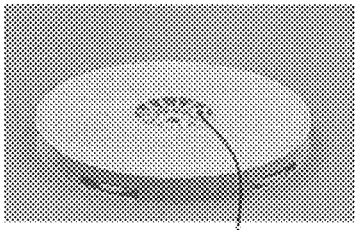
Figure 17E:
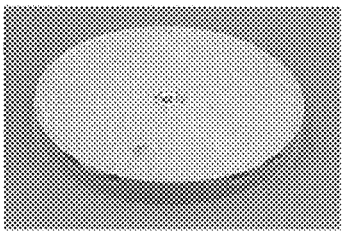

Thus, the mounting assembly 1504 illustrated in FIGS. 15A-F includes a base-mounted sliding bracket 1508 that connects on top of a clamp 1506 below, which secures to the horizontal pole shown. FIG. 15E illustrates a plurality of radially extending grooves 1510 formed in the bottom surface of the base-mounted sliding bracket 1508. These grooves 1510 are configured to mate with a plurality of radially extending ridges 1512 formed on the top surface of the clamp. When the base-mounted sliding bracket 1508 is screwed, or otherwise secured to the clamp 1506, as shown in FIGS. 15A-C, the base-mounted sliding bracket 1508 may be positioned at various angles. For example, the angle at which the base-mounted sliding bracket 1508 is mounted to the clamp 1506 in FIG. 15B is different from the angle at which it is mounted in FIG. 15C.

FIGS. 16A-D show pictures of another embodiment of a mounting assembly 1604 that includes a concave adapter 1606 secured beneath a base-mounted sliding bracket 1508. The concave adapter 1606 illustrated in FIGS. 16*a-d* includes a top surface having a plurality of radially extending ridges 1512, similar to those shown in FIGS. 15A-F, into which the radially extending grooves 1510 of the base-mounted sliding bracket 1508 may be inserted. As described above, the concave adapter 1606 includes one or more holes/passageways through which one or more straps pass. The strap(s) wrap around the pole to secure the beverage holder thereto. Also, combining the planar adapter 1308 with the convex interior surface 1310 shown in FIG. 16D with the concave adapter 1606 shown in FIGS. 16A-C, allows the mounting system 1508 of FIGS. 16A-D to adapt to a flat surface, similar to the mounting system 1304 shown in FIGS. 13A-D.

On will appreciate that the various clamps and mounting assembly components described herein may also include interior surfaces having curvatures that conform to other shaped poles, rods, and boards that are square, polygonal, or otherwise irregularly shaped.

In addition to the various embodiments of mounting system described herein, which are configured to secure beverage holders to poles, boards, and the like, FIGS. 17A-E show pictures of a mounting assembly 1704 configured to secure a beverage holder to other surfaces. In particular, mounting assembly 1704 includes a base mounted sliding bracket 1508 secured to a magnetic plate 1706. The magnetic plate 1706 may include one or more magnets 1708 disposed therein. As such, the mounting assembly 1704 can be magnetically coupled to any ferrous metal surface. As noted above, the base-mounted sliding bracket 1508 includes a plurality of radially extending grooves 1510 that correspond to a plurality of radially extending ridges 1512 formed in the base plate. According to this configuration, the base-mounted sliding bracket 1508 can be properly aligned on the magnetic plate 1706 when the two are screwed or otherwise rigidly secured together.

Figure 18:
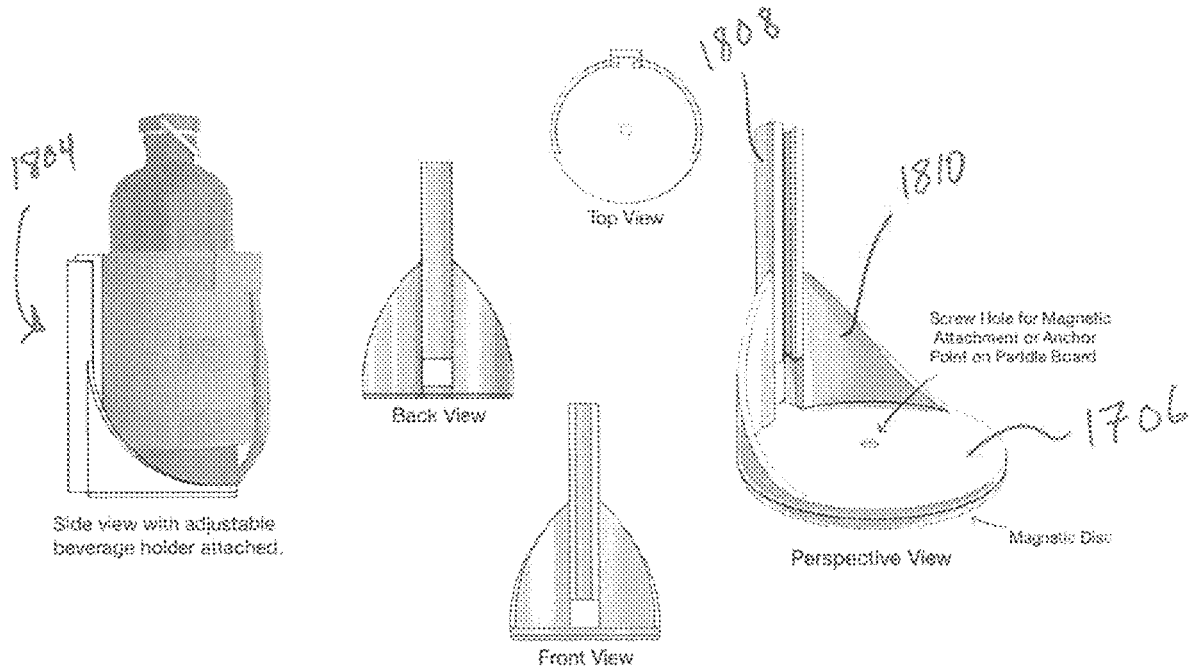
FIG. 18 illustrates various views of a mounting assembly, including a magnetic plate and an integrated sliding bracket, configured to secure a sleeve to a metal surface according to an embodiment of the present disclosure.

FIG. 18 illustrates various views of an alternative embodiment of a magnetic mounting assembly 1804 that includes a magnetic plate 1706 and an integrated female portion 1808 of a sliding bracket. The integrated female portion 1808 can include one or more extended portions 1810 that are integrally formed with both the female portion 1808 of the sliding bracket and the magnetic plate 1706. In one or more other embodiments, the female portion 1808 of the sliding bracket may be rigidly secured to the magnetic plate 1706 using a variety of other methods, such as screws, bolts, adhesives, welding, or the like.

Figure 19A:
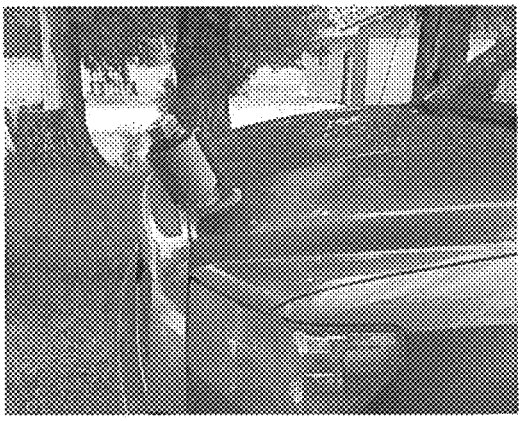
FIGS. 19A-B show pictures of mounting brackets and sleeves, similar to those illustrated in FIGS. 17*a-e* and 18, mounted to a metal surface according to an embodiment of the present disclosure.
Figure 19B:
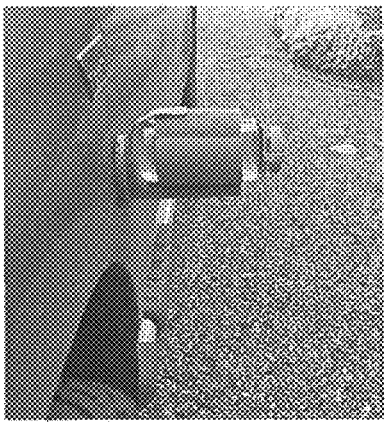

In the embodiment of the mounting assembly 1804 illustrated in FIG. 18, the male portion of the sliding bracket, which is attached to the sleeve of the beverage holder, can be inserted into the female portion 1808 of the sliding bracket to secure the beverage container thereto. As illustrated in FIGS. 19A-B, the magnetic mounting assemblies illustrated in FIGS. 17A-18 can be magnetically secured to a ferrous metal surface, such as a vehicle, in an upright, horizontal, or angled position.

Figure 20A:
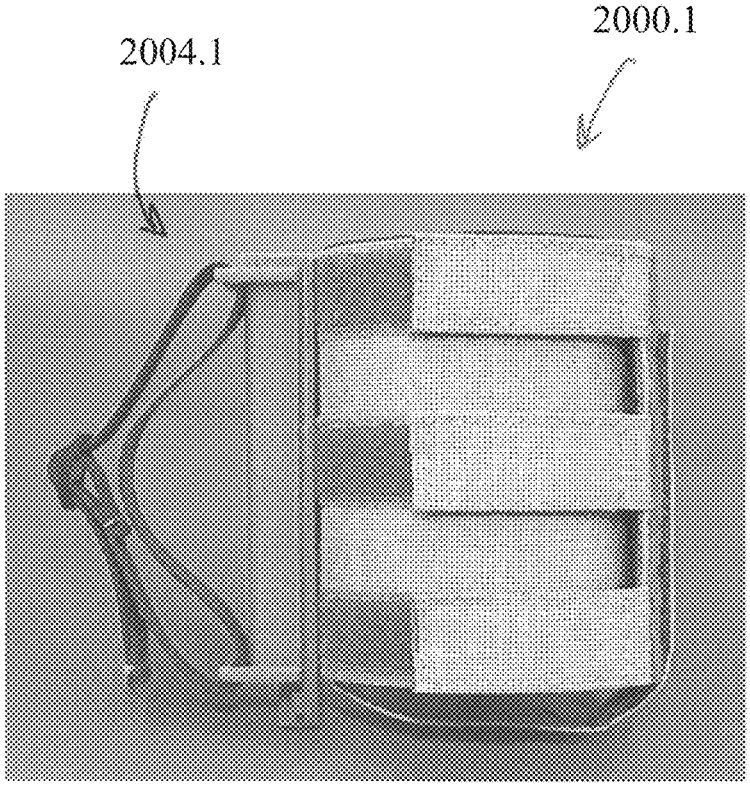
FIGS. 20A-B illustrate an adaptable beverage holder configured to be manually carried according to an embodiment of the present disclosure.
Figure 20B:
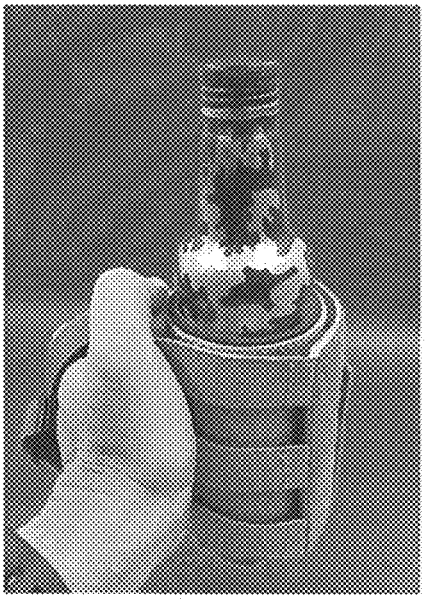

FIGS. 20A-B illustrate a beverage holder 2000.1 configured to be manually carried. The beverage holder 2000.1 includes a mounting assembly 2004.1 having a sliding bracket with a hole/passageway at the top and bottom ends thereof through which an adjustable strap may pass. The strap can be loosened or tightened to accommodate different hand sizes of users. FIG. 20B shows the mounting assembly 2004.1 in use.

Figure 21A:
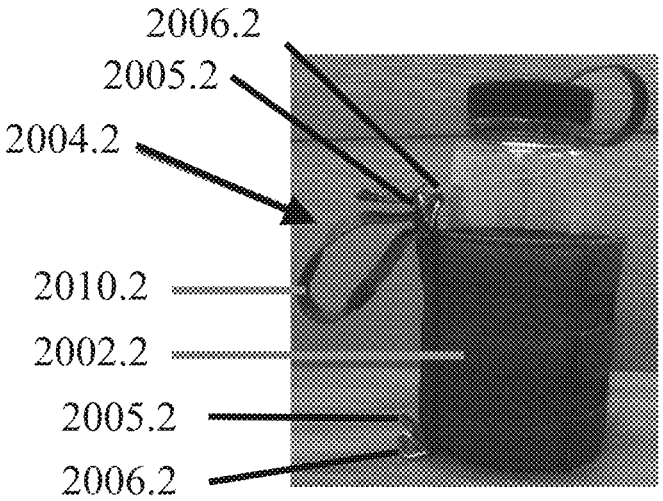
FIGS. 21A-E show pictures of an adaptable beverage holder in a first configuration according to another embodiment of the present disclosure.

As another example, FIG. 21A shows an embodiment of sleeve 2002.2 that includes a mounting assembly 2004.2. The intermediate layer of sleeve 2002.2 may comprise a more rigid material than the outer and inner layers, such that the intermediate layer provides a material to which mounting assembly 2004.2 components and other hardware may be rigidly secured. In some embodiments, as shown in FIGS. 21A-E, a portion of the intermediate layer may be thicker where hardware and mounting assembly 2004.2 components are to be secured.

Figure 21B:
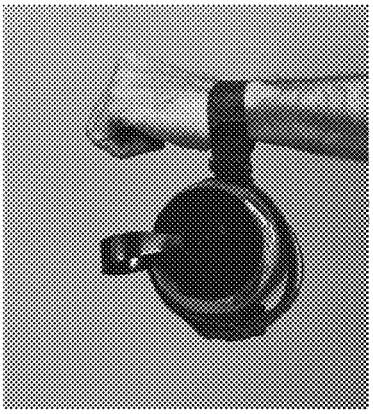
Figure 21C:
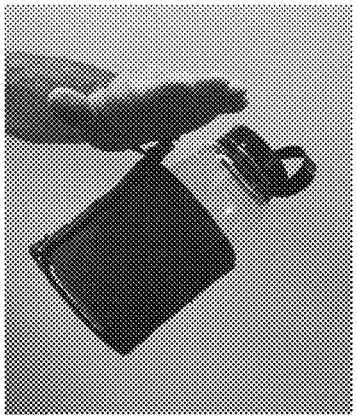
Figure 21D:
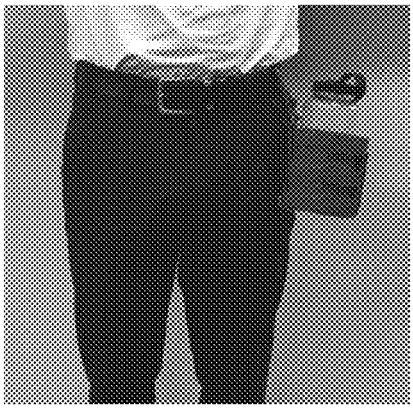
Figure 21E:
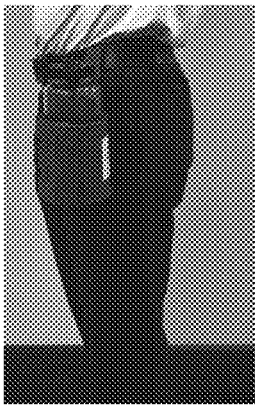

In the embodiment depicted by FIGS. 21A-E, the mounting assembly 2004.2 is configured in the shape of a selectively closed loop tether 2010.2. The position of the selectively closed loop tether 2010.2 may be at any location on the mounting assembly 2004.2 or any location on the sleeve 2002.2. In one embodiment, the position of the selectively closed loop tether 2010.2 is located on a top section of the mounting assembly 2004.2. In some embodiments, the selectively closed loop tether 2010.2 may be configured to attach to the wrist of a user, as shown in FIGS. 21B-C. In other embodiments, the selectively closed loop tether 2010.2 may be configured to attach to the belt of a user, as shown in FIGS. 21D-C. These examples are not exclusive configurations of the selectively closed loop tether 2010.2. Rather the selectively closed loop tether 2010.2 may be configured for a plurality of uses, including a handle, an attachment to a horizontal support, an attachment to a vertical support, an attachment to a diagonal support, or any other configuration and/or combination of configurations.

In one embodiment of the mounting assembly 2004.2, a first end of the selectively closed loop tether 2010.2 is permanently affixed to the mounting assembly 2004.2 and a second end of the selectively closed loop is fastened to the mounting assembly 2004.2 by at least one ring fastener. In one embodiment, as shown in FIG. 21A, the second end of the selectively closed loop tether 2010.2 is fastened to the mounting assembly 2004.2 by a first upper ring fastener 2005.2 and a second upper ring fastener 2006.2. Particularly, the second end of the selectively closed loop tether 2010.2 may be threaded through both the first upper ring fastener 2005.2 and the second upper ring fastener 2006.2, then folded over the exterior of the second upper ring fastener 2006.2 and threaded back through the interior of the first upper ring fastener 2005.2, as shown in FIG. 21A.

In at least one embodiment, as depicted by FIGS. 22A-E, the mounting assembly 2004.3 can be configured in the shape of an at least a partially closed loop tether 2010.3. In one embodiment of the mounting assembly 2004.3, a first portion or end 2007.2 of the partially closed loop tether 2010.3 is permanently affixed to the mounting assembly 2004.3 and a second portion or end 2008.2 of the partially closed loop is fastened to the mounting assembly 2004.3 by at least one ring fastener. In one example, the second portion or end of the partially closed loop tether 2010.3 is fastened to the mounting assembly 2004.3 by a first lower ring fastener 2005.2 and a second lower ring fastener 2006.2. Particularly, the second end of the partially closed loop tether 2010.3 is threaded through both the first lower ring fastener 2005.2 and the second lower ring fastener 2006.2, then folded over the exterior of the second lower ring fastener 2006.2 and threaded back through the interior of the first lower ring fastener 2005.2.

In some embodiments, the loop tether 2010 can be selectively arranged in or switched between a first configuration and a second position, as shown in FIGS. 21 and 22. For instance, the second end of the tether can be selectively connected to and switched between the upper and lower ring fasteners to change the type of loop created with the tether.

In one example, the loop tether is oriented in the vertical direction. Alternatively, the loop tether is oriented in the horizontal direction. Alternatively, the loop tether is oriented in a diagonal direction. In some embodiments, the first portion or end of the loop tether is located at the top of the mounting assembly and the second portion or end of the loop tether is located at the bottom of the mounting assembly. In some examples, the loop tether may be configured to attach to the wrist of a user, as shown in FIGS. 21B-C. In other examples, the loop tether may be configured to attach to the belt of a user, as shown in FIGS. 21D-E and 22D-E. These examples are not exclusive configurations of the loop tether. Rather the loop tether may be configured for a plurality of uses, including a handle (as shown in FIGS. 22B-C), an attachment to a horizontal support, an attachment to a vertical support, an attachment to a diagonal support, or any other configuration and/or combination of configurations.

Figure 22A:
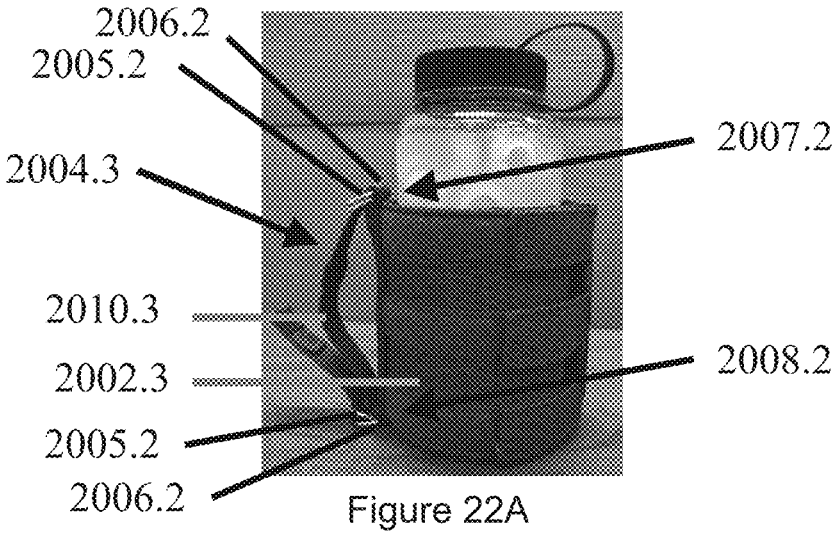
FIGS. 22A-E show pictures of the adaptable beverage holder of FIGS. 21A-E in a second configuration.
Figure 22B:
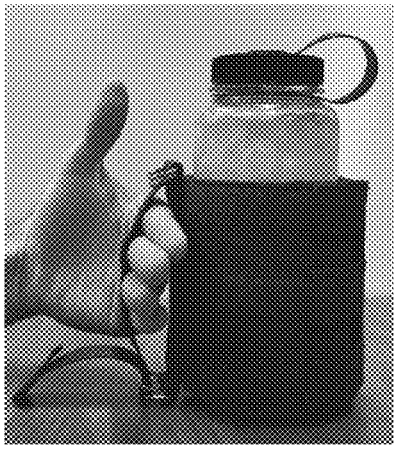
Figure 22C:
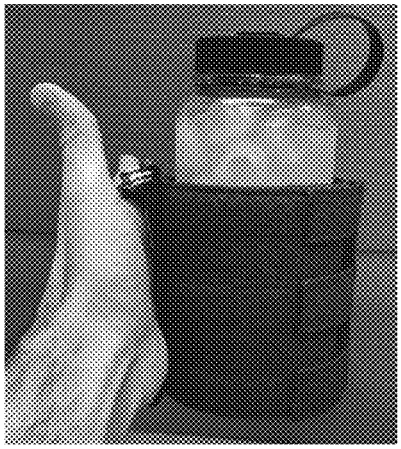
Figure 22D:
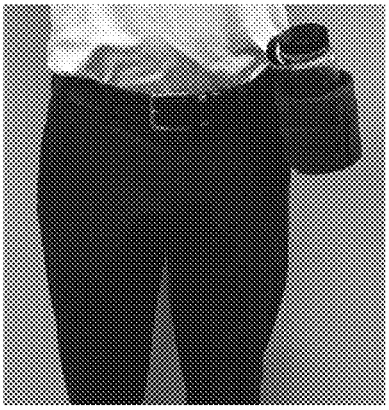
Figure 22E:
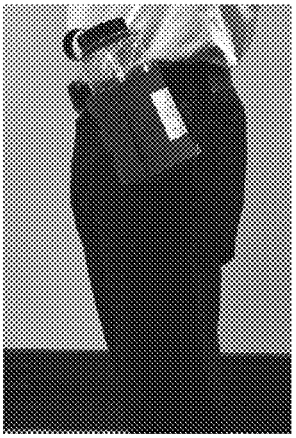

As noted above, in some embodiments, the mounting assembly 2004.2 shown in FIG. 21A and the mounting assembly 2004.3 FIG. 22A may be configured to be interchangeable. That is, the selectively closed loop tether 2010.2 may be configured to be converted to a partially closed loop tether 2010.3. Similarly, a partially closed loop tether 2010.3 may be configured to be converted to a selectively closed loop tether 2010.2 using the same mounting assembly 2004.2 and the same sleeve 2002.2.

For example, a user can configure the beverage holder to have a closed loop tether 2010.2 shown in FIGS. 21A-E and then rearrange mounting assembly 2004.2 to form the partially closed loop tether 2010.3 illustrated in FIG. 22A-E. This reconfiguration of mounting assembly 2004.2 can be done quickly and conveniently to adapt to the needs of the user as the user participates in different activities. During some activities, for example walking or lounging in a boat, the user may prefer the closed loop tether 2010.2, while during other activities, for example biking or hunting, the user may prefer the partially closed loop tether 2010.3.

FIGS. 23A-G show pictures of a locking mechanism 2100, including a key 2102, configured to prevent a male portion of a sliding bracket from disengaging a female portion of a sliding bracket. The locking mechanism also includes a keyhole 2104 through which the key 2102 is inserted. In the illustrated embodiment, the keyhole 2104 is located at or near the bottom of the sliding bracket. However, in one or more other embodiments, the keyhole 2104 may be located at or near the top of the sliding bracket. The keyhole 2104 extends through both male and female portions of the sliding bracket so that a single hole traverses both portions when the male and female portions are fully engaged with one another.

Figure 23A:
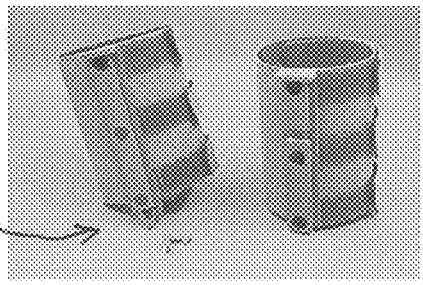
FIGS. 23A-G show pictures of a locking mechanism, including a key, configured to hold a sliding bracket together according to an embodiment of the present disclosure.
Figure 23B:
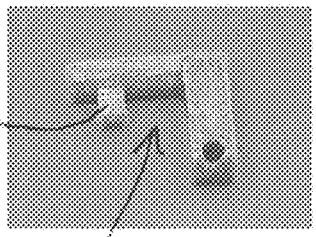
Figure 23C:
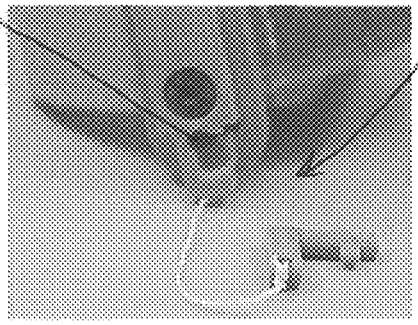
Figure 23D:
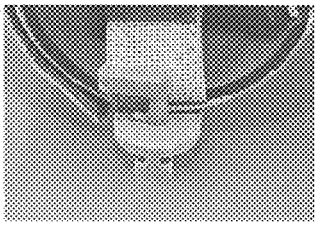
Figure 23E:
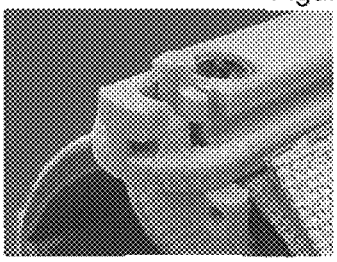
Figure 23F:
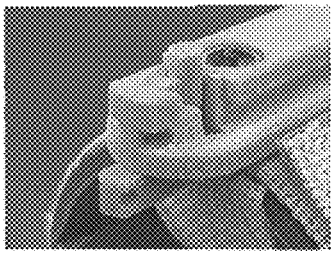
Figure 23G:
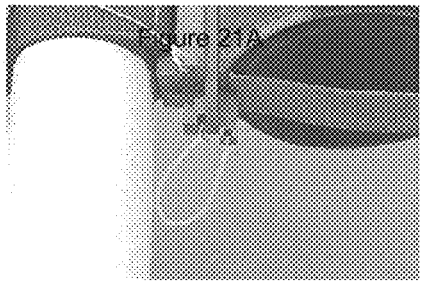

FIG. 23B illustrates a key 2102 that includes a locking protrusion 2106. As shown in FIG. 23E, the key may be inserted into the keyhole 2104 that extends through both male and female portions of the sliding mechanism. Once the key 2102 is inserted all the way through, so that the locking protrusion is fully outside the keyhole 2102, the key 2102 may be rotated, as shown in FIG. 23F, so that the locking protrusion 2106 prevents the key from retreating through the keyhole 2104. In this way, the locking mechanism 2100 prevents the male and female portions of the sliding bracket from disengaging with one another after being coupled together.

FIGS. 24A-E show pictures of another embodiment of a locking mechanism 2200, including an elongated key 2202, notch 2204, and passageway 2208, configured to hold a sliding bracket together. In the illustrated locking mechanism 2200 of FIGS. 24A-E, the male portion of the sliding bracket comprises a slot 2204 extending horizontally thereacross. A corresponding passageway 2208 extends through the female portion of the sliding bracket so that the passageway 2208 and slot 2204 align when the male and female portions of the sliding bracket are fully engaged with one another.

Figure 24A:
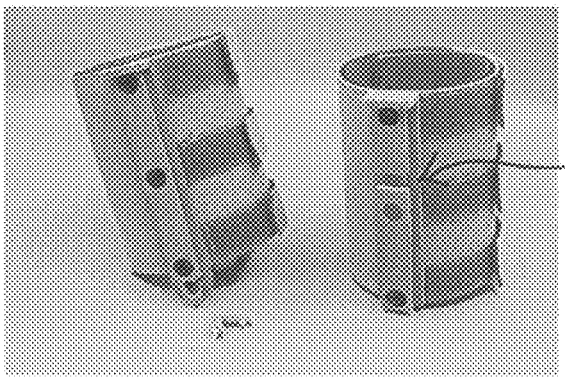
FIGS. 24A-E show pictures of a locking mechanism, including a key, configured to hold a sliding bracket together according to an embodiment of the present disclosure.
Figure 24B:
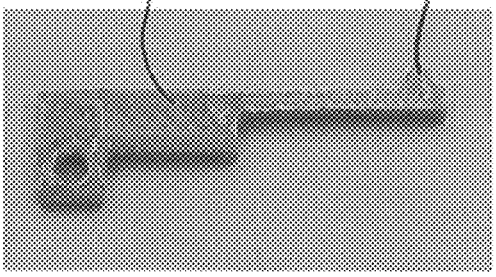
Figure 24C:
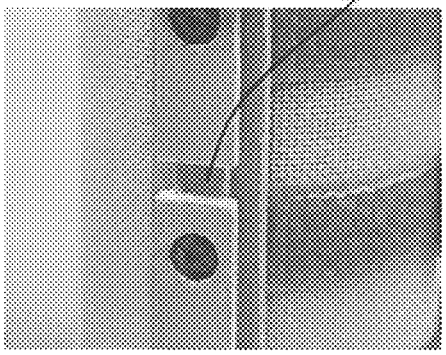
Figure 24D:
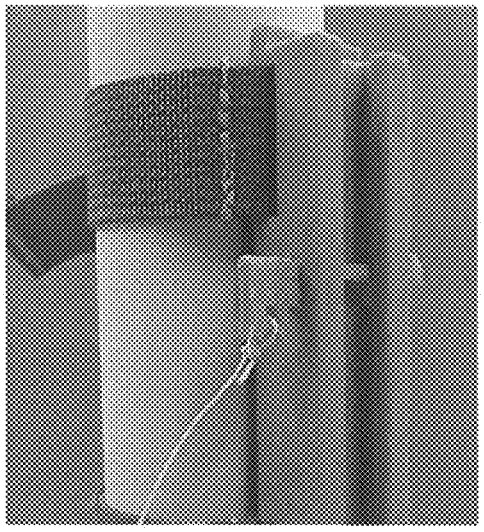
Figure 24E:
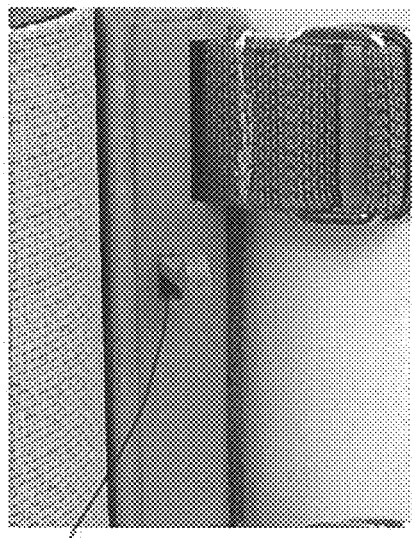

The elongate key 2202 includes a tapered locking protrusion 2206 that extends perpendicular to the elongated key 2202 on one side and is tapered on the other. Once the male and female portions of the sliding mechanism are aligned, the key 2202 may be inserted through the passageway 2208 and slot 2204 until the tapered locking protrusion 2206 extends out of the passageway 2208, as shown in FIG. 24E. The tapered side of the tapered locking protrusion 2206 comes into contact with an inside surface of the female portion of the sliding bracket and causes the elongated key 2202 to flex downward while it is pushed horizontally through the passageway 2208.

Once the tapered locking protrusion is fully inserted therethrough, the elongated key elastically returns to its resting position. In this position, the perpendicular side of the tapered locking protrusion 2206 prevents the elongated key 2202 from retreating through the passageway 2208 and slot 2204, unless a user first manually depresses the tapered locking protrusion 2206 downward. In this way, the locking mechanism 2200 illustrated in FIGS. 24A-E may prevent the male and female portions of the sliding bracket from disengaging one another after installation.

It will be appreciated that, in one or more other embodiments of the locking mechanism 2200 illustrated in FIGS. 24A-E, the sliding bracket may include a slot 2204 and corresponding passageway 2208 positioned anywhere along the length of the sliding mechanism. Also, one or more embodiments may include more than one slot 2204, passageway 2208, and elongated key 2202.

In additional to the various embodiments of adaptable beverage holders described herein, an Appendix is attached herewith that further illustrates and describes implementations, methods, and systems of adaptable beverage holders. The figures and accompanying descriptions presented in the Appendix are considered part of the present disclosure. Specific descriptions of adaptable beverage holder features described in the Appendix, including specific materials, dimension, configurations, colors, and other features, are to be considered in all respects only as illustrative and not restrictive.

The implementation of additional components and/or features known in the art and/or desirable in certain implementations of the present invention will be apparent to those skilled in the art and/or in light of the present disclosure. For instance, certain implementations may include sleeves having securing means other than hook-and-loop materials, including strap mechanisms, magnetic features, or other securing mechanisms known in the art. Furthermore, the absence of such known or apparent features should not be construed as restricting the scope or application of the present disclosure to the exclusion of such features.

The above-described implementations of the present invention are meant to be illustrative of example implementations and are not intended to limit the scope of the present invention. Various modifications, which would be readily apparent to one skilled in the art, are intended to be within the scope of the present invention. The only limitations to the scope of the present invention are set forth in the following claims appended hereto.

It is also understood that various implementations described herein may be utilized in combination with any other implementation described, without departing from the scope contained herein. Therefore, products, members, elements, devices, apparatus, systems, methods, and/or processes according to certain implementations of the present invention may include, incorporate, or otherwise comprise properties, features, components, members, elements, steps, and/or the like described in other implementations (including systems, methods, apparatus, and/or the like) disclosed herein without departing from the scope of the present invention. Thus, reference to a specific feature in relation to one implementation should not be construed as being limited to applications only within said implementation.

The present invention may be embodied in other specific forms without departing from its spirit or essential characteristics. The described implementations are to be considered in all respects only as illustrative and not restrictive. The scope of the invention is, therefore, indicated by the appended claims rather than by the foregoing description. While certain implementations and details have been included herein and in the attached invention disclosure for purposes of illustrating the invention, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

I claim:

1. An adaptable beverage holder, comprising:

an adjustable sleeve assembly having an inner layer, an outer layer, and an intermediate layer that is more rigid than the inner and outer layers, the inner layer comprising an insulating material; and a mounting assembly secured to the sleeve assembly, the mounting assembly being configured to secure the adaptable beverage holder to an object, at least a portion of the mounting assembly being rigidly secured to the intermediate layer.

2. The adaptable beverage holder of claim 1, wherein the inner layer comprises neoprene, the outer layer comprises a PVC polyester coated outdoor marine fabric, and the intermediate layer comprises High-Density Polyethylene (HDPE).

3. The adaptable beverage holder of claim 1, wherein the mounting assembly comprises a clamp.

4. The adaptable beverage holder of claim 1, wherein the mounting assembly comprises a tether, the tether comprising a first end connected or connectable to a first portion of the mounting assembly and a second end selectively connectable to the first portion of the mounting assembly or a second portion of the mounting assembly.

5. The adaptable beverage holder of claim 4, wherein the mounting assembly further comprises a ring assembly system, whereby the second end of the tether is selectively connectable to the ring assembly system.

6. The adaptable beverage holder of claim 4, wherein the tether is interchangeable between a selectively closed loop and a partially closed loop.

7. The adaptable beverage holder of claim 1, wherein the mounting assembly comprises a selectively closed loop.

8. The adaptable beverage holder of claim 1, wherein the mounting assembly comprises a partially closed loop.

9. The adaptable beverage holder of claim 8, wherein a first portion of the partially closed loop is connectable to a first portion of the mounting assembly.

10. The adaptable beverage holder of claim 9, wherein a second portion of the partially closed loop is connectable to a second portion of the mounting assembly.

11. An adaptable beverage holder, comprising:

an adjustable sleeve assembly having an inner layer, an outer layer, and an intermediate layer, the inner layer comprising an insulating neoprene material, the outer layer comprising a PVC polyester coated outdoor marine fabric, and the intermediate layer comprising High-Density Polyethylene (HDPE); and a mounting assembly secured to the sleeve assembly, the mounting assembly being configured to secure the adaptable beverage holder to an object, at least a portion of the mounting assembly being rigidly secured to the intermediate layer.

12. The adaptable beverage holder of claim 11, wherein the intermediate layer is more rigid than the inner and outer layers.

13. The adaptable beverage holder of claim 11, wherein the mounting assembly comprises a clamp.

14. The adaptable beverage holder of claim 11, wherein the mounting assembly comprises a tether, the tether comprising a first end connected or connectable to a first portion of the mounting assembly and a second end selectively connectable to the first portion of the mounting assembly or a second portion of the mounting assembly.

15. The adaptable beverage holder of claim 14, wherein the mounting assembly further comprises a ring assembly system, whereby the second end of the tether is selectively connectable to the ring assembly system.

16. The adaptable beverage holder of claim 14, wherein the tether is interchangeable between a selectively closed loop and a partially closed loop.

17. The adaptable beverage holder of claim 11, wherein the mounting assembly comprises a selectively closed loop.

18. The adaptable beverage holder of claim 11, wherein the mounting assembly comprises a partially closed loop.

19. The adaptable beverage holder of claim 18, wherein a first portion of the partially closed loop is connectable to a first portion of the mounting assembly.

20. The adaptable beverage holder of claim 19, wherein a second portion of the partially closed loop is connectable to a second portion of the mounting assembly.

* * * * *